US012678661B2

(12) United States Patent
Bayerlein et al.

(10) Patent No.: US 12,678,661 B2
(45) Date of Patent: Jul. 14, 2026

(54) SYSTEMS AND METHODS FOR MULTI-USER OPERATION ON A PIECE OF EXERCISE EQUIPMENT

(71) Applicant: Woodway USA, Inc., Waukesha, WI (US)

(72) Inventors: Douglas G. Bayerlein, Waukesha, WI (US); Eric Weber, Waukesha, WI (US); Vance E. Emons, Waukesha, WI (US); Jacob Hilsabeck, Shorewood, WI (US); Scott D. Hoerig, Waukesha, WI (US)

(73) Assignee: Woodway USA, Inc., Waukesha, WI (US)

( * ) Notice: Subject to any disclaimer, the term of this patent is extended or adjusted under 35 U.S.C. 154(b) by 5 days.

(21) Appl. No.: 18/399,299

(22) Filed: Dec. 28, 2023

(65) Prior Publication Data

US 2024/0131392 A1 Apr. 25, 2024

Related U.S. Application Data

(63) Continuation of application No. PCT/US2022/036014, filed on Jul. 1, 2022.
(Continued)

(51) Int. Cl.
*A63B 22/02* (2006.01)
*A63B 24/00* (2006.01)

(52) U.S. Cl.
CPC ..... *A63B 22/025* (2015.10); *A63B 24/0087* (2013.01); *A63B 2225/20* (2013.01); *A63B 2225/50* (2013.01)

(58) Field of Classification Search
CPC ..... A63B 22/025; A63B 24/0087; A63B 2225/20; A63B 2225/50; A63B 22/02;
(Continued)

(56) References Cited

U.S. PATENT DOCUMENTS 9,767,350 B2 * 9/2017 Rodriguez ..... G06F 16/335
2012/0237911 A1 9/2012 Watterson
(Continued)

FOREIGN PATENT DOCUMENTS

AU 2019209052 A1 7/2020
KR 102018280 B1 9/2019

OTHER PUBLICATIONS

International Search Report and Written Opinion on PCT PCT/US2022/036014 Dtd Oct. 11, 2022 (14 pages).
(Continued)

*Primary Examiner* — Sundhara M Ganesan
(74) *Attorney, Agent, or Firm* — Foley & Lardner LLP

(57) ABSTRACT

An exercise and/or therapeutic machine includes a controller. The controller is configured to: receive at least one input indicating a number of users of the exercise and/or therapeutic machine for a multi-user routine and a number of segments of the multi-user routine, each segment of the number of segments having an interval specific to each user of the number of users; receive at least one completion designation associated with at least one interval, wherein the at least one completion designation indicates a completion of the at least one interval; transition between each interval of each segment based on detecting the at least one completion designation associated with the at least one interval so that each user of the number of users participates in the multi-user routine on the same exercise and/or therapeutic machine; and generate and provide a display regarding a summary of the multi-user routine.

20 Claims, 16 Drawing Sheets

Related U.S. Application Data

(60) Provisional application No. 63/217,964, filed on Jul. 2, 2021.

(58) Field of Classification Search
CPC .... A63B 24/0084; G16H 40/63; G16H 40/67; G16H 50/70; G16H 20/30
See application file for complete search history.

(56) References Cited

U.S. PATENT DOCUMENTS

| | | | |
|---|---|---|---|
| 2013/0079203 | A1 | 3/2013 | Jones |
| 2015/0258382 | A1 | 9/2015 | Nolan et al. |
| 2020/0179760 | A1 | 6/2020 | Werner et al. |
| 2024/0001201 | A1 | 1/2024 | Tana et al. |

OTHER PUBLICATIONS

Woodway USA. "Woodway PT Pro Software Owner's Manual", 2010, Woodway USA.
Woodway. "The Woodway Pt Pro", Feb. 15, 2011, www.woodway.com.
Extended European Search Report on EP 22834335.6 DTD Mar. 21, 2025.

* cited by examiner

SYSTEMS AND METHODS FOR MULTI-USER OPERATION ON A PIECE OF EXERCISE EQUIPMENT

CROSS-REFERENCE TO RELATED APPLICATION

This application is a continuation of International Patent Application No. PCT/2022/036014, filed Jul. 1, 2022, which claims the benefit of and priority to U.S. Patent Application No. 63/217,964, filed Jul. 2, 2021, both of which are incorporated herein by reference in their entireties and for all purposes.

TECHNICAL FIELD

The present disclosure relates to exercise and therapeutic devices. More particularly, the present disclosure relates to a system and method for operating a multi-user workout or therapeutic mode of operation for an exercise and/or therapeutic device, such as a treadmill.

BACKGROUND

Exercise and therapeutic devices include elliptical machines, weight racks and benches, rowing machines, resistance training devices, treadmills, and a variety of other pieces of equipment. With references to treadmills, treadmills enable a person to walk, jog, skip, or run for a relatively long distance in a limited space by having a running belt that moves in the opposite direction of the treadmill user.

Treadmills can be used for a variety of exercise and/or therapeutic activities. Such activities may involve high intensity interval workouts, with some workouts involving or requiring multiple treadmill users (e.g., relay training, circuit training, etc.). When running with others during a cooperative or parallel workout, the task of maintaining accurate workout parameters for each treadmill user can become unwieldly. Although users can use multiple treadmills, the problem of synchronicity and coordination remains.

SUMMARY

One embodiment relates to an exercise and/or therapeutic machine. The exercise and/or therapeutic machine includes a controller including at least one processing circuit having at least one processor coupled to at least one memory device. The controller is configured to: receive at least one input indicating a number of users of the exercise and/or therapeutic machine for a multi-user routine and a number of segments of the multi-user routine, each segment of the number of segments having an interval specific to each user of the number of users; receive at least one completion designation associated with at least one interval, wherein the at least one completion designation indicates a completion of the at least one interval; transition between each interval of each segment based on detecting the at least one completion designation associated with the at least one interval so that each user of the number of users participates in the multi-user routine on the same exercise and/or therapeutic machine; and generate and provide a display regarding a summary of the multi-user routine.

Another embodiment relates to a method of operating an exercise and/or therapeutic machine. The method includes: receiving, by at least one controller of the exercise and/or therapeutic machine, at least one input indicating a number of users of the exercise and/or therapeutic machine for a multi-user routine and a number of segments of the multi-user routine, each segment of the number of segments having at least one interval specific to each user of the number of users; receiving, by the at least one controller, at least one completion designation associated with the least one interval, wherein the at least one completion designation indicates a completion of the at least one interval; transitioning, by the at least one controller, between each interval of each segment based on detecting the at least one completion designation associated with at least one interval so that each user of the number of users participates in the multi-user routine on the same exercise and/or therapeutic machine; and generating and providing, by the at least one controller, a display regarding the multi-user routine.

Still another embodiment relates to a treadmill. The treadmill includes a display device and a controller coupled to the display device. The controller includes at least one processing circuit having at least one processor coupled to at least one memory device. The controller is configured to: receive at least one input indicating a number of users of the treadmill for a multi-user routine and a number of segments of the multi-user routine, each segment of the number of segments having an interval specific to each user of the number of users; receive at least one completion designation associated with at least one interval of at least one segment, wherein the at least one completion designation indicates a completion of the at least one interval of the at least one segment; transition between adjacent intervals of a segment based on detecting the at least one completion designation associated with the at least one interval so that at least two users of the number of users participate in the multi-user routine on the treadmill; and cause the display device to provide a display regarding a summary of the multi-user routine.

Numerous specific details are provided to impart a thorough understanding of embodiments of the subject matter of the present disclosure. The described features of the subject matter of the present disclosure may be combined in any suitable manner in one or more embodiments and/or implementations. In this regard, one or more features of an aspect of the invention may be combined with one or more features of a different aspect of the invention. Moreover, additional features may be recognized in certain embodiments and/or implementations that may not be present in all embodiments or implementations.

BRIEF DESCRIPTION OF THE FIGURES

The disclosure will become more fully understood from the following detailed description, taken in conjunction with the accompanying figures, wherein like reference numerals refer to like elements.

DETAILED DESCRIPTION

Figure 1:
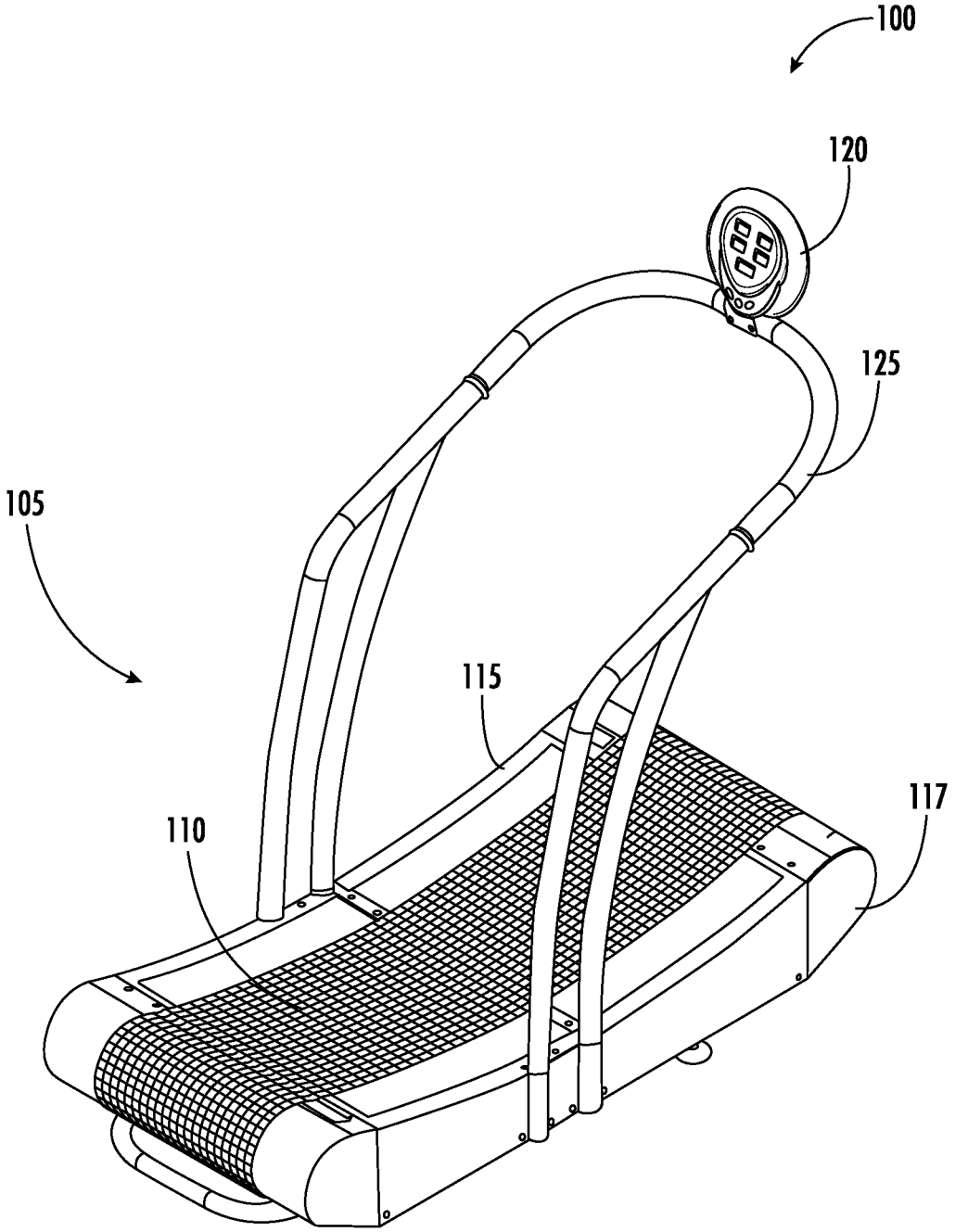
FIG. 1 is a front perspective view of a treadmill, according to an exemplary embodiment.

Before turning to the Figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the Figures, systems, methods, and apparatuses for controlling and operating a piece of exercise and/or therapeutic equipment is shown according to various embodiments described herein. While the "piece of exercise and/or therapeutic equipment" is shown and described primarily herein as a treadmill, this description is for exemplary purposes only. The present disclosure is applicable with other pieces of exercise and therapeutic equipment as well including, but not limited to, elliptical machines, rowing machines, stair-training machines, bikes, bikes with hand crank devices, and so on. Thus, the treadmill description contained herein is not meant to be limiting.

According to the present disclosure, a treadmill includes a control system that is configured to control, at least partly, operation of the treadmill. The control system or controller is configured to facilitate and provide a multi-user mode of operation for the treadmill. The "multi-user mode of operation" may also be referred to as a group mode, a multi-user or group workout mode, a multi-user or group workout and/or therapeutic mode, and the like. In operation, the control system prompts a user of the treadmill to input or provide a workout parameter for a multi-user mode of operation that may include, but is not limited to, a number of users (e.g., participants) for the multi-user workout, a number of workout segments, a number and duration of intervals within each segment, a speed associated with each user and the interval, target performance metrics, and/or other information that defines the multi-user workout or routine for the treadmill. The user may then initiate the multi-user workout on the treadmill. During the workout, the control system controls the treadmill according to the workout parameters to enable a first user to use the treadmill for a first workout interval and subsequently enable a second or next user to use the same treadmill for a second workout interval, wherein each of the first workout interval and the second workout interval are associated with a time, speed, and/or particular workout parameter specific to the respective first and second users. Thus, in use, the control system provides a continuous workout or routine that accommodates multiple users using the same treadmill without the users having to input workout specifics for their individual use of the treadmill during the group workout mode. In this way, a seamless experience is provided for multiple users of the same treadmill. These and other features and benefits are described more fully herein below.

Referring now to FIG. 1, a treadmill 100 is shown, according to an exemplary embodiment. The treadmill 100 may be a non-motorized treadmill that is powered by the user, or the treadmill 100 may be a motorized treadmill having at least one motor for actuation (i.e., driving rotation of a running belt for the treadmill). In the example shown, the treadmill 100 is non-motorized. In another embodiment, the treadmill 100 may include a motor. As shown in FIG. 1, the treadmill 100 includes a base 105, which generally includes the assembly of components located proximate to a support surface (e.g., floor, ground, etc.) upon which the treadmill 100 is placed, rests upon, sits on, etc. The base 105 includes a running belt 110, which extends along a length of the base 105 and defines a running axis for a user of the treadmill 100. In various embodiments, the running belt 110 may define a planar (or substantially planar) running surface. In other embodiments, the running belt 110 may define a non-planar running surface (e.g., curved). The running belt 110 may be disposed between side panels 115 and 117 (e.g., covers, shrouds, etc.), which are provided on transverse opposing sides of the base 105. As shown, the treadmill 100 includes an input/output device 120 coupled to a handrail 125 that is coupled to the base 105 of the treadmill.

Although FIG. 1 shows the handrail 125 as being coupled to the base 105 in a central region adjacent the side panels 115, 117, the handrail 125 may be coupled to the base 105 at any region desired. Similarly, although FIG. 1 shows the input/output device 120 as a discrete unit disposed at a widthwise or transverse central portion of the handrail 125, the input/output device 120 may be integrated within the handrail 125 and/or disposed anywhere along the handrail 125 (or in another not-attached positioned relative to the handrail).

The input/output device 120 is structured to enable inputs to be received by a user or other treadmill operator and provide outputs to the user or other operator of the treadmill.

In the example shown, the input/output device 120 is a display device coupled to the treadmill 100. That said, the input/output device 120 may also include, but is not limited to, a touchscreen display (e.g., LED, OLED, LCD, etc.), pressable buttons, levers, knobs, and/or touch-sensitive regions. In this regard, the input/output device 120 may include a capacitive touch screen and/or a pressure sensitive display to enable user input. In various embodiments, the input/output device 120 includes one or more microphones and/or speakers thereby providing an audio and/or audio and visual output. In some embodiments, the input/output device 120 is configured to provide haptic feedback to a user interacting with the input/output device 120. For example, vibratable elements may be included with the handrails that vibrate (e.g., shake, rumble, etc.) based on one or more commands, instructions, or signals from the control system. Thus, the input/output device 120 may include input only devices (e.g., a button or lever), output only devices (e.g., a speaker), or input and output devices (e.g., a touchscreen display).

Figure 2:
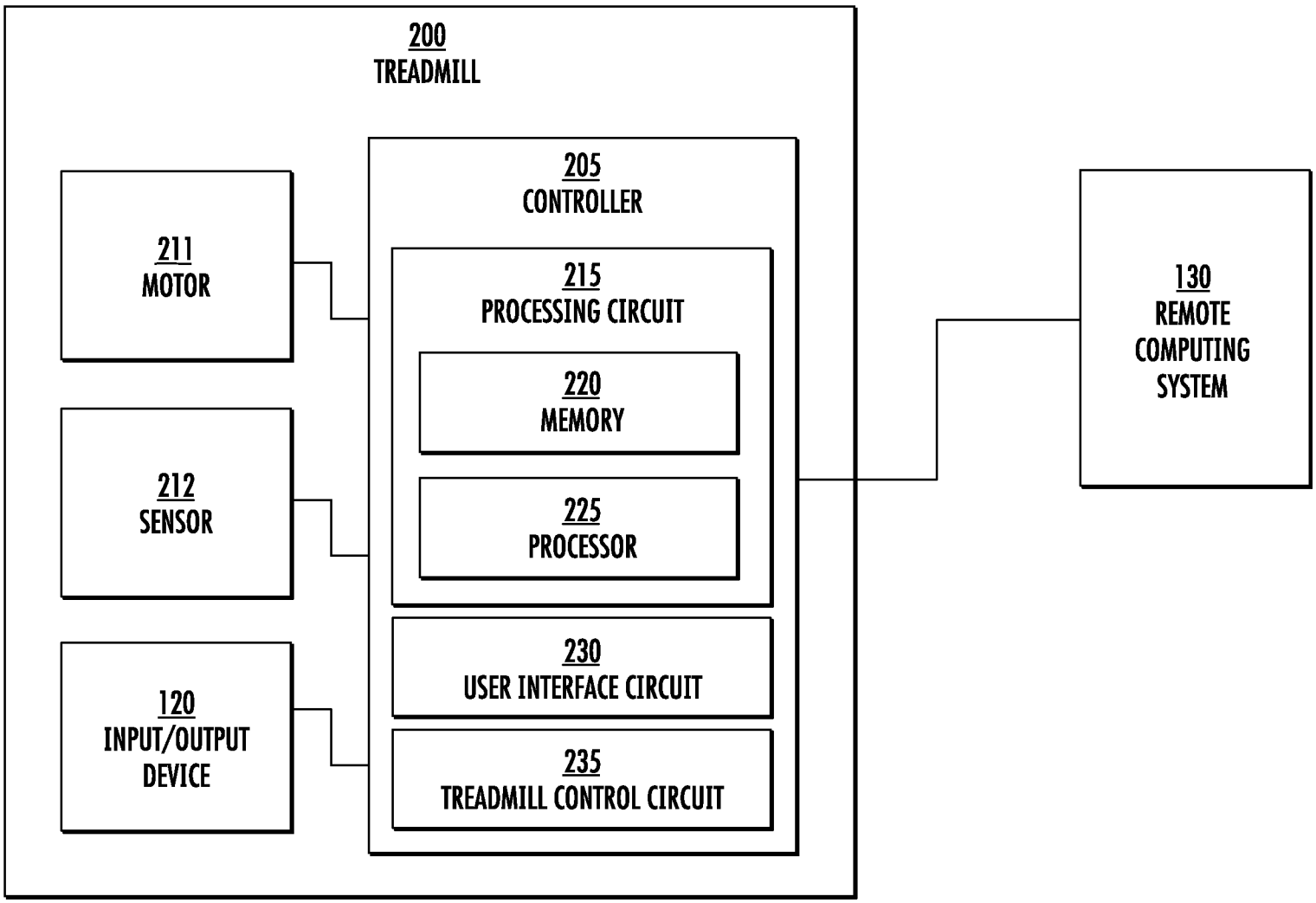
FIG. 2 is a schematic representation of a treadmill, according to another exemplary embodiment.

Referring now to FIG. 2, a schematic representation of a treadmill 200 is shown, according to an example embodiment. In the example shown, the treadmill 200 is a motorized treadmill. In various embodiments, the treadmill 200 may include some or all of the components of the treadmill 100, such as the input/output device 120, belt 110 (that defines a planar or non-planar running surface, such as a curved running surface), base, 105, side panels 115 and 117, and handrail 125. Although FIG. 2 shows a particular combination of elements arranged in a particular way, this embodiment is not meant to be limiting. In this regard, the treadmill 200 may include more, less, or different components than depicted in FIG. 2. It should be understood that while the paragraphs that follow describe the treadmill as being the treadmill 200 (i.e., a motorized treadmill), the same or similar description may apply to the treadmill 100 except with the references to the control and operation of the motor as the treadmill 100 is motor-less. Thus, the description contained herein below is equally applicable with motor-less, manually-powered treadmills.

As shown, the treadmill 200 includes a controller 205 that includes at least one processing circuit 215, which includes a memory 220 and a processor 225. The controller 205 also includes a user interface circuit 230 and a treadmill control circuit 235. The controller 205 is coupled to a motor 211, one or more sensors 212, the input/output device 120, and a remote computing system 130. The controller 205 is coupled to the input/output device 120, which is configured to receive an input from one or more users of the treadmill 100. As shown and indicated above, the treadmill 200 is motorized; however, as mentioned above, this is not meant to be limiting as in other embodiments, a motor may be excluded such that the treadmill 200 is a non-motorized treadmill, such as treadmill 100. As described herein, the controller 205 is configured or structured to control operation of the treadmill 200.

The treadmill 200 (e.g., controller 205) may be communicatively coupled to the remote computing system 130 (e.g., server system, computing device or system, mobile computing devices, stationary computing devices, etc.) via a network. In this regard, the remote computing system 130 may be a tablet computer, a user device (e.g., mobile phone, smartphone, etc.), a multi-user terminal positioned remotely to the input/output device 120 (e.g., a kiosk), a handheld remote or control device, etc. Accordingly, the remote computing system 130 may include a database, memory, or other non-transitory computer readable medium in addition to one or more processors and any other suitable computing components to facilitate and enable communicable coupling with the input/output device 120 and controller of the treadmill. In this way, the remote computing system 130 may receive one or more inputs from the controller 205 and send one or more instructions to the controller 205 to cause, for example, the input/output device 120 to provide one or more outputs to a user of the treadmill 200 or control operation of the treadmill 200, such as remotely initiate the multi-user workout mode described herein.

The motor 211 may control at least one of a speed or an incline of the treadmill 200 (i.e., a speed of the belt 110 and/or an incline of the base 105). The motor 211 may be configured to actuate (power, drive, or otherwise cause rotation of) the belt 110 by selectively providing and not providing power or rotational force to the belt 110 to operate the treadmill 100 in accordance with various desired modes of operation. In various embodiments, the motor 211 may include one or more output shafts coupled to one or more pulleys, motor belts, gears, chains, and/or other suitable features for translating driving and/or braking action of the motor 211 to the running belt 110.

The motor 211 may be structured as any type of motor that may be used to selectively power (e.g., impart force to or otherwise drive rotation of) the running belt 110. Accordingly, the motor 211 may be an alternating current (AC) motor or a direct current (DC) motor and be of any power rating desired. In various embodiments, the motor 211 is structured as a brushed DC motor or a brushless DC motor. Further, the motor 211 may receive electrical power from an external source (e.g., from a wall outlet) or from a power source integrated into the treadmill 200, such as a battery. Additionally, the motor 211 may be solely a motor or be a motor/generator combination unit (i.e., capable of generating electricity).

The one or more sensors 212 are configured or structured to sense a condition (e.g., speed) associated with the treadmill 200. For example, the one or more sensors 212 may sense a speed at which the belt 110 is moving to determine a run speed of the user of the treadmill 100 (i.e., a belt speed sensor). Accordingly, the one or more sensors 212 may include, but are not limited, an incline sensor (e.g., an inclinometer) and elevation limit switch that may define boundaries of the allowable relative incline for the treadmill 200, heart rate sensors (e.g., heart rate contacts disposed within the handrail 125 to detect a user heart rate when the user places their hands on the handrail 125), weight sensors (i.e., structured to acquire data indicative of a weight of a user), stride length sensors, pressure sensors, other biometric sensors (e.g., eye-location sensors), and so on. Accordingly, the sensors 212 may be hall effect sensors, capacitive sensors, and any other suitable type of sensors. Further, the sensors 212 may be disposed in any desirable location of the treadmill 200. Those of ordinary skill in the art will appreciate and recognize that the aforementioned embodiments are not meant to be limiting as the present disclosure contemplates additional sensor types and configurations that are intended to fall within the scope of the present disclosure.

The controller 205 may be structured to control implementation and operation of multi-user workout mode for the treadmill 200 as described herein. Accordingly, the controller 205 may be structured as a variety of different types of controllers with one or more of a variety of components. In this regard and as shown, a single controller 205 is employed with the treadmill. However, the controller 205 may in some embodiments be constructed as a series of controllers or components with the elements geographically dispersed within the treadmill 200.

The controller 205 may include one or more processing circuits 215 including one or more processors 225 communicably coupled to one or more memory devices 220. The one or more processors 225 may be implemented as any type of processor including an application specific integrated circuit (ASIC), one or more field programmable gate arrays (FPGAs), a digital signal processor (DSP), a group of processing components, or other suitable electronic processing components. The one or more memory devices 220 (e.g., NVRAM, RAM, ROM, Flash Memory, hard disk storage, etc.) may store data and/or computer code for facilitating the various processes described herein. Thus, the one or more memory devices 220 may be communicably coupled to the one or more processors 225 and provide computer code or instructions for executing the processes and operations described in regard to the controller 205 herein. Moreover, the one or more memory devices 220 may be or include tangible, non-transient volatile memory or non-volatile memory. Accordingly, the one or more memory devices 220 may include database components, object code components, script components, or any other type of information structure for supporting the various activities and information structures described herein.

The controller 205 may further include an integrated power source (e.g., a battery, capacitator(s), and/or other electrical power sources) and/or be coupled to a power source to enable reception of powering to power the controller 205 (e.g., a wall outlet, etc.). In this regard, the treadmill 200 may be electrically coupled to a power source (e.g., wall outlet, portable battery, etc.) that may power one or more components of the treadmill 200 (e.g., controller 205, input/output devices, motor, etc.).

In some embodiments, the controller 205 may include a communications interface configured to enable remote communications and the exchange of information with remote computing devices (e.g., tablet computers, etc.)(i.e., the remote computing system 130). In this regard, the controller 205 may be configured as part of a data cloud computing system configured to receive commands from the remote computing system 130 and provide information to the remote computing system 130 (as well as the input/output device 120). The communications interface may include any combination of a wireless network transceiver (e.g., Bluetooth® transceiver, cellular modem, a Wi-Fi® transceiver) and/or wired network transceiver (e.g., an Ethernet transceiver, phone connection port/jack, etc.). The communications interface may include hardware and machine-readable media structured to support communication over multiple channels of data communication (e.g., Bluetooth®, near-field communication, etc.). The communications interface may include one or more cryptography modules to establish a secure communication session (e.g., using the IPSec protocol or similar) in which data communicated over the session is encrypted and securely transmitted. Thus, the communications interface may include any one or more of a cellular transceiver (e.g., CDMA, GSM, LTE, etc.), a wireless network transceiver (e.g., 802.11X, ZigBee, WI-FI, Internet, etc.), wired network transceivers, and a combination thereof. Thus, the communications interface enables connectivity to wide-area network (WAN) as well as local area network (LAN). Accordingly, the "network" that supports communications to remote computing devices, such as the remote computing system, may be any one or more of the Internet, other WAN, LAN, Bluetooth, NFC, and so on.

The controller 205 is shown to include a user interface circuit 230 and a treadmill control circuit 235. The user interface circuit 230 is structured to generate user interfaces that are provided to and displayed by the input/output device 120. The treadmill control circuit 235 is structured to control various components of the treadmill including, but not limited, an elevation adjustment system to adjust an incline of the treadmill, the motor 211 to control a running belt speed (as part of the group workout mode), and any other controllable component in the treadmill. In one embodiment, the circuits 230 and 235 are embodied as machine or computer-readable media storing instructions that is executable by a processor, such as processor 225. In another embodiment, the circuits 230 and 235 are embodied as hardware units, such as electronic control units (e.g., integrated circuits (IC), discrete circuits, system on a chip (SOCs) circuits, microcontrollers, etc.). In yet another embodiment, the circuits 230 may be formed from any combination of hardware and/or software.

The controller 205 may be configured to receive inputs from and/or send outputs to the input/output device 120 via the user interface circuit 230. In various embodiments, the controller 205 is also configured to receive one or more inputs from a database (e.g., such as a database within the remote computing system 130). For example, the remote computing system 130 may contain one or more predefined workouts, user profiles, and/or preset parameters associated with operation of the treadmill 200, which the controller 205 may selectively receive and, subsequently use to control the treadmill 200 (in particular, as described herein, facilitate and enable a multi-user workout mode of operation).

Figure 3:
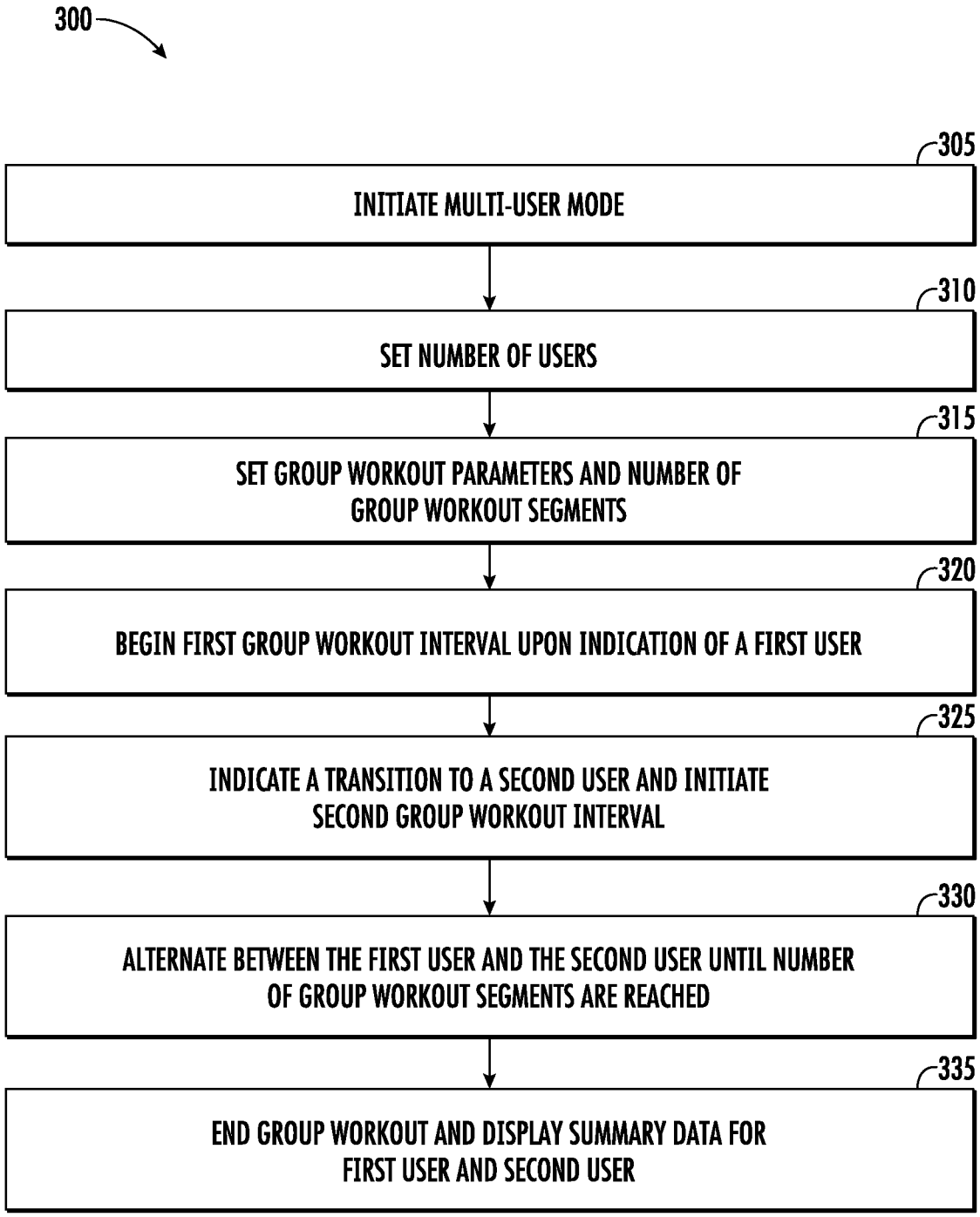
FIG. 3 is a flow diagram of a method of using the treadmill of FIG. 2, according to an exemplary embodiment.

As described herein, the controller 205 is configured, adapted, and/or structured to facilitate multi-user operation of the treadmill 200. Referring now to FIG. 3, a flow diagram illustrating a method 300, which may be carried out by the controller 205 to control operation of the treadmill 200, is shown, according to an example embodiment. As mentioned above and for the sake of emphasis, it should be noted that although the method 300 is described herein as being carried out by the controller 205 to control operation of the treadmill 200, the method 300 may be adapted for operation of a non-motorized treadmill, such as the treadmill 100, by the controller 205.

In operation 305, the input/output device 120 receives an input from a user to initiate a multi-user mode operation for the treadmill 200. The "user" may be a leader or organizer for the group and participate in the group work out mode. Alternatively, the user may be an instructor who does not participate in the group work out mode. The controller 205, from the input/output device 120, then receives the input to initiate the multi-user mode of operation. In various embodiments, the input/output device 120 may include a button configured to initiate the multi-user mode. In other embodiments, the input/output device 120 includes a visual display, wherein the input/output device 120 may present one or more mode options to a user via the visual display. The one or more mode options may include the multi-user mode, which the user can select by touching, pressing, or speaking to the input/output device 120. In other embodiments, a user (group class instructor, remote treadmill operator, etc.) may select the multi-user mode option by inputting their selection into the remote computing device 130 (e.g., tablet), which may be transmitted over the network to the treadmill 200 and, particularly the controller 205, to in turn remote initiate the group mode of operation.

At operation 310, the controller 205, via the user interface circuit 230, may generate a graphical display (e.g., the graphical display being provided by the input/output device 120) that is provided via the input/output device 120. In some embodiments, the controller 205 may generate the graphical user interface and transmit it to the remote computing system 130 for display to the remote operator (e.g., class instructor). The initial display for the group mode of operation includes a prompt or request for information regarding operation of the group mode, which includes setting a number of users (e.g., 2, 3, 4, 7, 12, etc.) for the multi-user mode of operation of the treadmill 200.

At operation 315, the controller 205, via the user interface circuit 230, generates a graphical display that includes a prompt or request to the user for entering a number of segments for the group workout. As used herein, a "group workout segment" or "segment" corresponds to a portion of the group workout where each of the users of the defined group of users complete or attempt to complete their own specific interval. An "interval" refers to a period of use for each of the users during each segment of the multi-user mode. As an example, the number of users for the multi-user mode of operation may be four, and there are eight total segments of the group work out mode, and four intervals per segment corresponding to each person's usage of the treadmill during each particular segment (one interval per one user). As described herein, the "segment" start and end time may correspond with each user's interval for that segment being complete. As described herein, during operation 315, the user may define metrics for each interval. The metrics may refer to a time duration for each user's interval, a predefined distance for each user's interval, a predefined power output (e.g., kilowatts) or calories for each user's interval, and/or any other trackable use metric of the treadmill 200. In this way, each user may have to complete the interval (e.g., run on the treadmill at 3 MPH for 3 minutes) before transitioning to the next person's interval. Once each interval is complete, the segment of the group workout mode of operation is completion.

Still in operation 315, the controller 205 may receive a designation of the number of cycles of the group mode of operation. In various embodiments, the input/output device 120 may provide a graphical display generated by the controller 205 to prompt or query the user to set a number of cycles or repetitions for the group workout. As used herein, a "cycle" refers to the number of repetitions or instances that the group mode of operation is executed. In particular, the cycle defines how many times or instances the defined segments of the multi-user work out mode is repeated before concluding the multi-user workout mode. In this way, each segment may be the same or different from the other segments. More particularly, the predefined metrics for the intervals of each segment may be the same or different for each segment. As an example, the first segment may correspond with intervals having predefined time metrics (e.g., each user must complete 3 minutes at a speed of their choice on the interval), while a second segment may correspond with intervals having predefined distance metrics (e.g., each user must run 2 miles on the treadmill for their interval). The user may then set the number of cycles as two, such that the controller 205 controls operation of the treadmill 200 to perform the first segment then the second segment (cycle 1), and then the first segment again and the second segment again (cycle 2).

In various embodiments, each interval may correspond with a predefined completion designation (predefined metric mentioned above and also referred to as an interval completion designation) that is received by the controller 205 (e.g., via the input/output device 120 or via the remote computing system 130). Accordingly, the controller 205 may advance to the next interval when at least one condition for the predefined completion designation is reached. The completion designation may be the same or different for each interval of each segment. In some embodiments, each of the users has the same completion designation for each interval while in other embodiments, at least one of the users of the group mode has a different completion designation for their interval relative to the other users in the group. As an example, in a two user group mode of operation, the controller 205 may receive a designation that each user's interval for the first segment corresponds with a predefined time completion designation (e.g., two minutes) while the second segment (of two segments) corresponds with a predefined distance completion designation (e.g., 2 miles). As another example and still in a two user group mode of operation, the controller 205 may receive an input that a first user's interval for the first segment corresponds with a predefined time completion designation (e.g., two minutes) and a second user's interval for the first segment corresponds with a predefined distance completion designation (e.g., 2 miles). In this example, the interval completion designations for each user for each segment are different while in the previous example, the interval completion designations for each segment are the same but are different between segments. The predefined interval completion designations are highly configurable with a few examples provided below.

In one embodiment, the interval completion designation for an interval is a predefined time threshold. Thus, an interval is determined as complete by the controller 205 based on expiration of the time threshold. For example, each interval may be completed after 30 seconds, 2 minutes, 5 minutes, 20 minutes, or any other time set by the user. Accordingly, the controller 205 may include a timer that counts or times each user's use of the treadmill 200 during their interval to signify or indicate when that user's interval is complete.

In other embodiments, the interval completion designation may be a predefined distance (e.g., 2 miles, 5 miles, etc.), energy expenditure (e.g., 100 calories), power generation (e.g., 20 kW) associated with a user or each user, a physiological marker (e.g., heart rate, body temperature, etc. that reaches a predefined level), and/or any other metrics that may be tracked via the controller 205. In various embodiments, the first interval and each subsequent interval may have the same or different completion designation. In some embodiments, the physiological marker may be sensed and recorded by a user device (e.g., a wearable user device such as a heart rate monitor, watch, fitness tracker, pulse oximeter, etc.) and transmitted to the controller 205 (e.g., via Bluetooth pairing, NFC, hard wired connection, etc.), where the controller 205 may receive the information (e.g., signal) from the user device indicating the physiological marker associated with particular user to determine if conditions for the interval completion designation have been satisfied.

Referring still to operation 315, the controller 205 (e.g., from an input via the input/output device 120 or via the remote computing system 130) may receive one or more control parameters for each interval. The "control parameters" refer to parameters or settings that control operation of the treadmill 200 during the interval. Accordingly, the "control parameters" may include one or a combination of a running belt speed designation, an incline designation, a resistance designation (e.g., the motor 211 may apply a resistance to the movement of the running belt as described in U.S. Pat. No. 10,238,911, which is incorporated herein by reference in its entirety), or other parameters that control operation and a user experience on the treadmill. In one embodiment, the controller 205 is configured to operate the treadmill 200 at the same control parameters for each interval (same speed, incline, resistance, etc. for each user's interval). In another embodiment, the controller 205 controls operation of the treadmill according to at least one different control parameter for each interval (e.g., the first user's interval may correspond with different control parameters (e.g., motor speed, etc.) relative to the second user's interval). Based on the received control parameters for each interval, the controller 205 may cause the motor 211 to operate at a first speed and/or the treadmill 200 to be at first incline during the first interval (when the first user is using the treadmill 200) and operate at a second speed and/or a second incline during the second or subsequent interval whereby the first and second speeds and inclines may be the same or different from each other. Further, multiple and changing control parameters for each interval may be received and implemented by the controller 205. For example, during an interval, the controller 205 may cause the motor to operate at a first speed for a predefined amount of time and a second greater speed during another predefined amount of time to form the "interval" for that user.

As another example, the controller 205 may adjust/control the treadmill 200 operation settings based on the segment. For example, the controller 205 may send an input to the motor 211 and/or height elevation system (e.g., a system that raises the incline of the treadmill) to cause the speed and/or incline of the treadmill 200 within each interval of the second segment to be greater than the speed and/or incline within each interval of the first segment.

After the number of cycles, segments, and intervals are set, the controller 205, in operation 320, may generate a graphical display via the user interface circuit 230 that provides a prompt to a user of the group of users to begin the first interval of the first segment of the group workout. As described above, the number of intervals within each of the group workout segments corresponds to the number of users within the group of users for the multi-user workout mode of operation. Once the group workout begins, a first user of the group of users may then use the treadmill 200 (e.g., run) during the first interval of the first segment. Once the first interval is complete, the controller 205 may prompt a second user to use the treadmill during a corresponding second interval of the first segment (operation 325). During operation, the controller 205 may cause the input/output device 120 to generate a graphical display, which may depict information for each user (i.e., of the group of users) during each corresponding interval (e.g., provide an indication of a target speed or other goal for the particular interval of each segment of the group workout).

In operation 330, once each user of the group of users has completed a corresponding interval on the treadmill 200, the controller 205 may cause the input/output device 120 to provide or display a graphical display, which may prompt the group of users to complete subsequent workout segments until the preset number of segments is reached. In each subsequent group workout segment, the controller 205 may generate a graphical display that is provided by the input/output device 120 that indicates an order in which each user of the group of users should use the treadmill 200 based on the specified group workout. For example, if there are only two users within the group of users, the controller 205 may generate and provide a graphical display via the input/output device 120 that indicates that the first user should use the treadmill 200 after the second user has used the treadmill.

In operation 335, once the group workout is completed, the controller 205 may end the group workout and cause the input/output device 120 to provide a graphical display, which depicts summary information for each of the users of the multiple users. In this regard, the sensors may track each individual user's workout on the treadmill. The controller 205 may accumulate the tracked information (e.g., heart rate, total distance, peak speed, calorie count, etc.) and provide it as a summary depiction via the input/output device 120. In some embodiments, the controller 205 may send this information to the remote computing system 130, such that an operator or instructor can view the information, or make the information to the users at a later date. For example, the users may desire to track and log their workouts. By sending the information to the remote computing system 130, which may include a fitness account manager for the user (e.g., a treadmill manufacturer), the users of the group workout may be able to access and view their workout information at a later date to track their progress over time.

In various embodiments, the controller 205 may be configured to automatically advance through operations 320 through 335 without input from users of group of users for the multi-user workout mode. In other words, the controller 205 may facilitate automatic or nearly automatic transitions between users for each interval. Because a single treadmill 200 is facilitating multi-users to use it during one group workout mode of operation, the controller 205 is configured to facilitate transitions between the users to enable a seamless and enjoyable experiences for the users.

In one embodiment, the controller 205 provides a prompt via the input/output device 120 to initiate a transition when the interval completion designation is determined as being met or reached by the controller 205. For example, the controller 205 may generate a graphical display that is provided by the input/output device 120 indicating that the user's interval is complete and to switch to the next user. The prompt may be provided visually (e.g., eye appealing colors such as red to indicate stop and green to indicate go for the next user), audibly (e.g., a beep, chirp, a message like "Your interval is complete. Next User.", etc.), or a combination thereof. As part of the transition, the controller 205 may set the treadmill for the next user's interval. Thus and when the completion designation is reached, the controller 205, via the treadmill control circuit 235, may stop operation of the motor and lower the incline to a normal operating position. The controller 205, via the input/output device 120, may indicate a stopping of the treadmill before doing so to help aid the user stopping their interval. Thus, the transition of one interval to the next may correspond with the controller 205 reverting the treadmill back to a start position (i.e., a predefined incline of operation, zero treadmill belt speed, etc.). If the treadmill is non-motorized, the controller 205 may revert the incline of the treadmill to a predefined normal position and provide audio, visual, and/or audio/visual cues to the user via the input/output device 120. The combination of treadmill control and cues may facilitate the transition between user intervals.

In another embodiment, controller 205 may sync or pair with user devices (e.g., via Bluetooth®, another network, etc.) to aid transitioning from one user to the next user for each interval. For example, a user may wear or otherwise have a device that may Bluetooth pair with the controller 205 (e.g., watch, phone, bracelet, necklace, pacemaker, heart rate monitor, etc.). As another example, the user may provide contact information (e.g., mobile phone number, etc.) to the controller 205 via the input/output device 120. As yet another example, a close-range tap of the controller 205 and the user device (e.g., near field communication) may establish a communication session that enables the exchange of information, such as contact information of the user to receive their workout summary and prompts to indicate when it is their turn on the treadmill for their interval. Each user may pair their device with the controller 205 and treadmill. During the multi-user workout, the controller 205 signals, information, etc. to the paired user device. For example, the controller 205 may provide a signal to a first user's fitness bracelet that causes the bracelet to vibrate to indicate that he/she is done with their interval. In parallel, the controller 205 may provide a signal to a second user's fitness bracelet that causes their bracelet to vibrate to indicate that he/she is next up on the treadmill 200 for their interval. As another example, the user's phone may vibrate, ring, or a combination thereof based on a signal from the controller 205 indicating a transition. This pairing and syncing of user devices with the controller 205 allows users to be relatively far distances away from the treadmill 200 (e.g., performing other parts of a workout) yet enable them to be easily reached to keep occupancy of the treadmill 200. This may be beneficial in large gym settings where users may be disposed on different floors of the gym and/or when the cues provided by the input/output device may be hard to be received by the next-up user.

Once a transition of users occurs, the controller 205 may automatically initiate the next user's interval operation. This may be done in a variety of ways. In one embodiment, the next user's interval operation is initiated based on the next user providing an input via the input/output device 120 (e.g., "begin", "start", etc.). The input from the user may include, but is not limited to, a voice command, depression of a button, touch of a touchscreen, and/or swiping of a fob. This input is received by the controller 205 and the controller then tracks operation of the treadmill relative to the predefined interval completion designation. As another example, the determination of the initiation of next user's interval of operation may be done automatically by the controller 205 without receiving an explicit user input. For example, the controller 205 may determine that the first user's interval is complete based on receiving an explicit input via the input/output device 120 that it is complete, and/or determine that it is complete based on received information indicative of non-use of the treadmill (e.g., zero belt speed, etc.). Thus, even if first user's interval completion designation is reached, the first user may walk on the treadmill after completion until the next user arrives. In which case, the controller 205 waits for a sign of inactivity before determining that it is complete. Then, the controller 205 may receive information regarding operation of the treadmill following information regarding inactivity and determine that the next user has begun operation. In response, the controller 205 may track the next user's progress relative to the interval completion designation metric. In some embodiments, the controller 205 may wait a preset amount of time between each interval to allow for a transition between each user and automatically initiate the subsequent interval without a user input or a sign of activity or inactivity on the treadmill. For example, once the first user has completed the first interval, the controller 205 may pause for a short period of time (e.g., 5 seconds, 10 seconds, etc.) while the second user prepares for the second interval on the treadmill 200.

As mentioned above, the transition may be facilitated by syncing or pairing the controller 205 with one or more of the user's devices. In this way, the controller 205 may also determine to initiate a next interval based on information received from the user device. For example, the controller 205 may receive distance information from a user's fitness bracelet or mobile phone indicating that they are within a predefined distance (e.g., 20 inches) and determine that the next user is onboard the treadmill to initiate the next user's interval. In another embodiment, a combination of the using information from the user devices with any of the aforementioned means may be used by the controller to determine when a transition to the next user occurs and to initiate the next user's interval.

In various embodiments, the controller 205 may generate a graphical display, which depicts a transition timer corresponding to the preset amount of time between each interval or an estimated time for the controller 205 to complete changing one or more operating parameters of the treadmill 200 (e.g., an estimated amount of time for the running belt 110 to reach a complete stop or an estimated amount of time for the base 105 to reduce the incline).

Based on the foregoing, additional details, exemplary graphical user interfaces, and other features of the multi-user workout mode are described herein.

Figure 4:
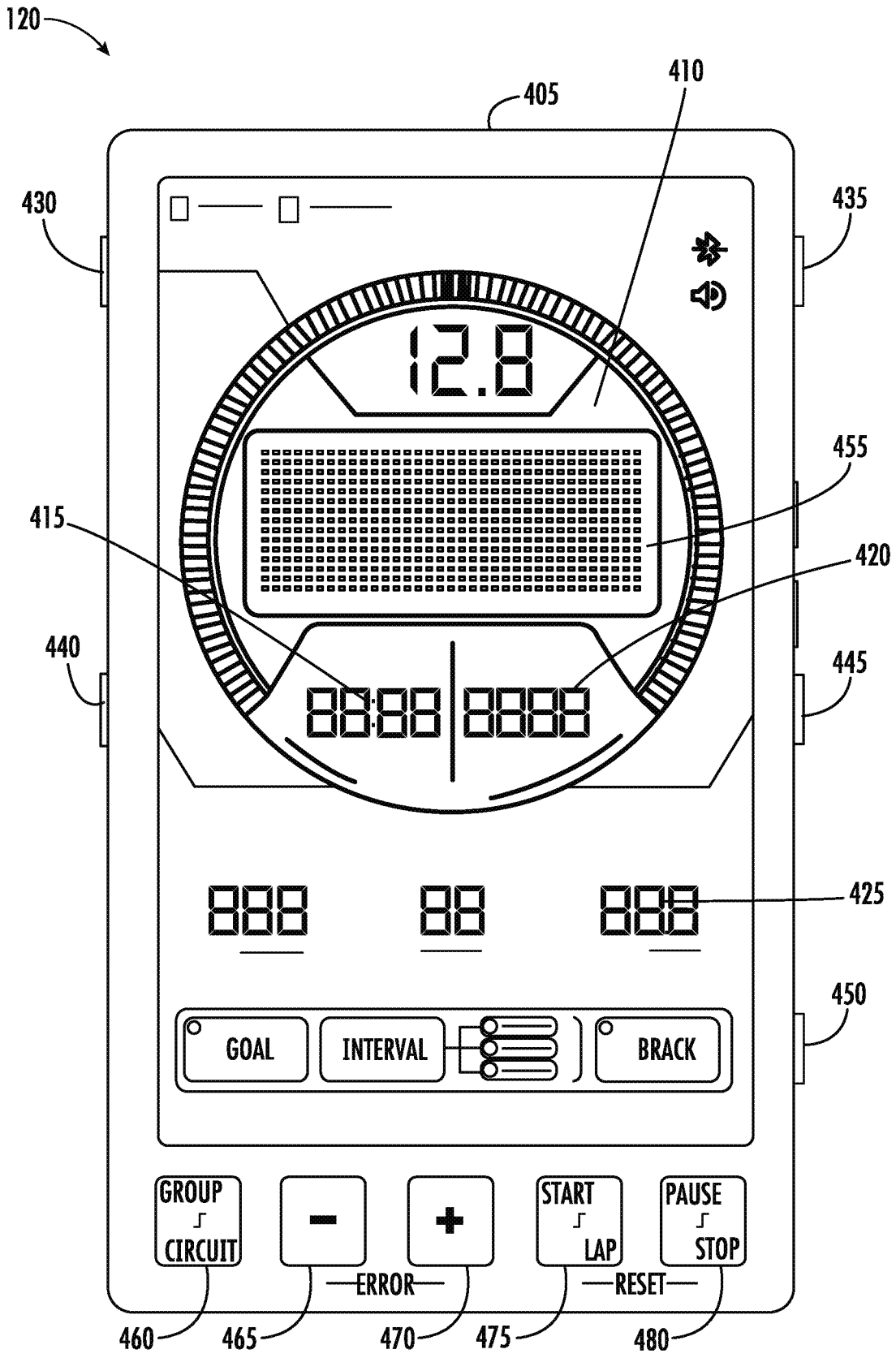
FIG. 4 is a schematic representation of an input/output device for the treadmill of FIG. 1, according to an exemplary embodiment.

Referring now to FIG. 4, an example input/output device 120 for an exercise and/or therapeutic piece of equipment that is shown as input/output device 400 is depicted, according to an exemplary embodiment. The input/output device 400 may be configured as a standalone unit mounted to the non-motorized treadmill 100 (e.g., to the handrail 125) and include a housing 405 and a first display 410 (i.e., be used in place of the input/output device 120). Although the input/device 400 is described herein as coupled to the non-motorized treadmill 100, the input/output device 400 may be adapted for coupling to and operation with a motorized treadmill (e.g., similar or equivalent to the treadmill 200). In various embodiments, the controller 205 may be included within the input/output device 400 and thus contained within the housing 405. In this configuration, however, the motor control functionality may be excluded/removed or disabled from the controller 205.

As shown in FIG. 4, the first display 410 may display a running speed to a user of the treadmill 100. The running speed may correspond to an operation speed of the treadmill 100 (i.e., a speed of the motor 211 if the input/output device 400 is coupled to the treadmill 200) or the speed may indicate a sensed speed (e.g., by the one or more sensors disposed within the base 105) at which the user is running while on the treadmill 100 (i.e., if the treadmill is non-motorized).

The input/output device 400 also includes a second display 415, which may show a time associated with an interval or segment of the group workout, and a third display 420, which may show an energy readout associated with an interval or segment of the group workout. In various embodiments, the time shown on the second display 415 indicates a time elapsed or time remaining within the interval or segment of the group workout. Accordingly, the controller 205 may cause the second display 415 to reset or update the time shown based on the interval or segment of the group workout. In various embodiments, the energy readout shown on the third display 420 may be an estimated calorie consumption of the user based on the speed and/or time associated with the user during a particular interval or segment. In other embodiments, the energy readout may be based on inputs received by the controller 205 from the monitoring device associated with the user. Finally, the input/output device 400 may also include a fourth display 425, which may show various other metrics associated with the group workout (or an interval or segment of the group workout) including, but not limited to, a distance, a heart rate, a segment number, an interval number, etc.

The input/output device 400 also includes input controls (e.g., buttons) 430, 435, 440, 445, and 450. The input controls 430 may be configured to toggle between various modes associated with the treadmill 100. For example, the input control 430 may cause the first display 410 to toggle among a current speed, a peak speed, and an average speed associated with a particular interval and/or segment. The input control 435 may be configured to toggle a speaker operation within the input/output device 400 and/or initiate a pairing mode associated with the input/output device 400. For example, the input control 435 may mute interval or segment notifications from the input/output device 400. The input control 435 may also be used to initiate pairing (e.g., via NFC, Bluetooth, etc.) between the controller 205 and a user device (e.g., tablet, cell phone, smart watch, etc.) or monitoring device (e.g., fitness bracelet, heart rate monitor, pulse oximeter, pacemaker, etc.) of the user as described above. The input control 440 may be configured to toggle between various time modes associated with the user interface. For example, the input control 440 may cause the second display 415 to toggle among an elapsed time (e.g., associated with a particular interval or segment), a remaining time (e.g., associated with the interval or segment), a total time (e.g., associated with the entire group workout), and a current pace (e.g., pace associated with a current running speed). The input control 445 may be configured to toggle between various energy modes associated with operation of the treadmill 100. For example, the input control 445 may cause the third display 430 to toggle among a number of expended calories by a user, a number of active calories, an amount of power generated by the user (e.g., in Watts), and a rate of energy expenditure by the user (e.g., measured as a metabolic equivalent of a task). Finally, the input control 450 may be configured to cause the controller 205 to toggle the input/output device 400 among various program options.

As shown in FIG. 4, the input/output device 400 includes at least one control input 460 for initiating the group workout. In various embodiments, the control input 460 may both initiate and end the group workout. When the control input 460 initiates the group workout (i.e., carrying out operation 305), a hub display 455 may indicate that the group workout has been initiated and will prompt a user to input the number of users within the group of users (i.e., carrying out operation 310). Control inputs 465 and 470 may be respectively used to decrease or increase the set number of users. In various embodiments, the default set number of users may be one and the maximum set number of users may be four. The number of users may be displayed in the hub display 455. To confirm the number of users, both control inputs 465 and 470 may be engaged simultaneously to set the number of users. After the number of users is set, the controller 205 may cause at least one of the displays 410, 415, 425, 430, 455 to prompt the user to input desired workout parameters associated with the group workout (i.e., carrying out operation 315), such as by prompting the user to input or select a completion designation of a workout interval (i.e., prompting the user to set the time threshold for each interval). Again, input controls 465 and 470 may be respectively used to alter the completion designation (e.g., decrease or increase the time threshold) for each group workout interval. To set the completion designation, input controls 465 and 470 may again be pressed simultaneously. After interval completion designation is set, the input/output device 400 may prompt the user to input or select a number of group workout segments, wherein the user can use input controls 465 and 470 to decrease or increase the number of segments and set the number of segments by pressing the input controls 465 and 470 simultaneously. In various embodiments, each interval completion designation may be based on at least one of a time threshold, a distance threshold, an energy expenditure, or other target parameter set by a user.

When the group workout parameters have been set (i.e., number of users for the multi-user workout mode, interval control parameters, number of segments, number of cycles, etc.), a control input 475 may be used to start the group workout. Accordingly, the hub display 455 may indicate the group workout is about to begin (e.g., by displaying a timer or countdown). The input/output device 400 may additionally or alternatively provide an audible indication (e.g., beep, chirp, siren, buzz, etc.) that the workout is starting. In various embodiments, the controller 205 may facilitate a warmup period prior to beginning the first group workout interval, where the treadmill may operate for a period of time as controlled by the controller 205 without regard for the completion designation associated with the first group workout interval. In other embodiments, the control input 475 may be used to skip at least one of the timer/countdown or the warmup period to advance to the first interval of the group workout.

Once the first interval of the group workout begins (e.g., carrying out operation 320), the hub display 455 may indicate which user (e.g., "User 1") corresponds to the particular group workout interval, along with an indication of which group workout segment is currently in progress (e.g., "Segment 1/10"). A first user mounts and uses the treadmill 100 during the first group workout interval. When the first interval ends based on a predetermined metric, also referred to as an interval completion designation, (e.g., time, distance, energy expenditure, etc.), the controller 205 may generate a graphical display (e.g., using displays 410, 415, 425, 430, 455) to indicate the first interval has ended and a second interval is about to begin (e.g., by displaying "User 2—press start to begin) and requesting an input from a second user to start the second interval (e.g., carrying out operation 325). As described above, the controller 205 may facilitate transitions between intervals until all users have completed segment 1 (e.g., carrying out operation 330). For example, if there are four users, the controller 205 may indicate (e.g., by generating a graphical display using displays 410, 415, 425, 430, 455 and/or by providing an audible indicator) when the first user, the second user, the third user, and the fourth user are to complete their respective intervals within the particular group workout segment. Once segment one of the group workout is completed, the controller 205 may advance the workout to the next segment and indicate (using the input/output device 120) the start of the next segment (e.g., "Segment 02/10"). The input/output device 400 then again prompts each user e.g., by generating a graphical display using displays 410, 415, 425, 430, 455 and/or by providing an audible indicator) to complete their corresponding group workout intervals until the group workout segment is completed. During the group workout, a control input 480 may be used to pause or resume the group workout.

When all group workout intervals within each group workout segment are completed, the controller 205 ends the group workout and causes the input/output device 400 to generate a graphical display (e.g., via the hub display 255) depicting user-specific group workout information, which may include, but is not limited to, a total treadmill 100 use time for each user within the group of users, a peak or average speed or pace, a total distance, and/or interval-specific splits or related statistics.

Referring now to FIGS. 5-16, example graphical user interfaces that facilitate the multi-user work out mode of operation as described in FIG. 3 are depicted. The graphical user interfaces may be generated by the controller and provided by the input/output device 120 (or, in certain embodiments, input/output device 400) at various times during operation of the motorized treadmill 200. It should be noted that although the graphical user interfaces shown in FIGS. 5-16 are described herein as relating to the motorized treadmill 200, the graphical user interfaces shown in FIGS. 5-16 can be adapted for use with the non-motorized treadmill 100.

Figure 5:
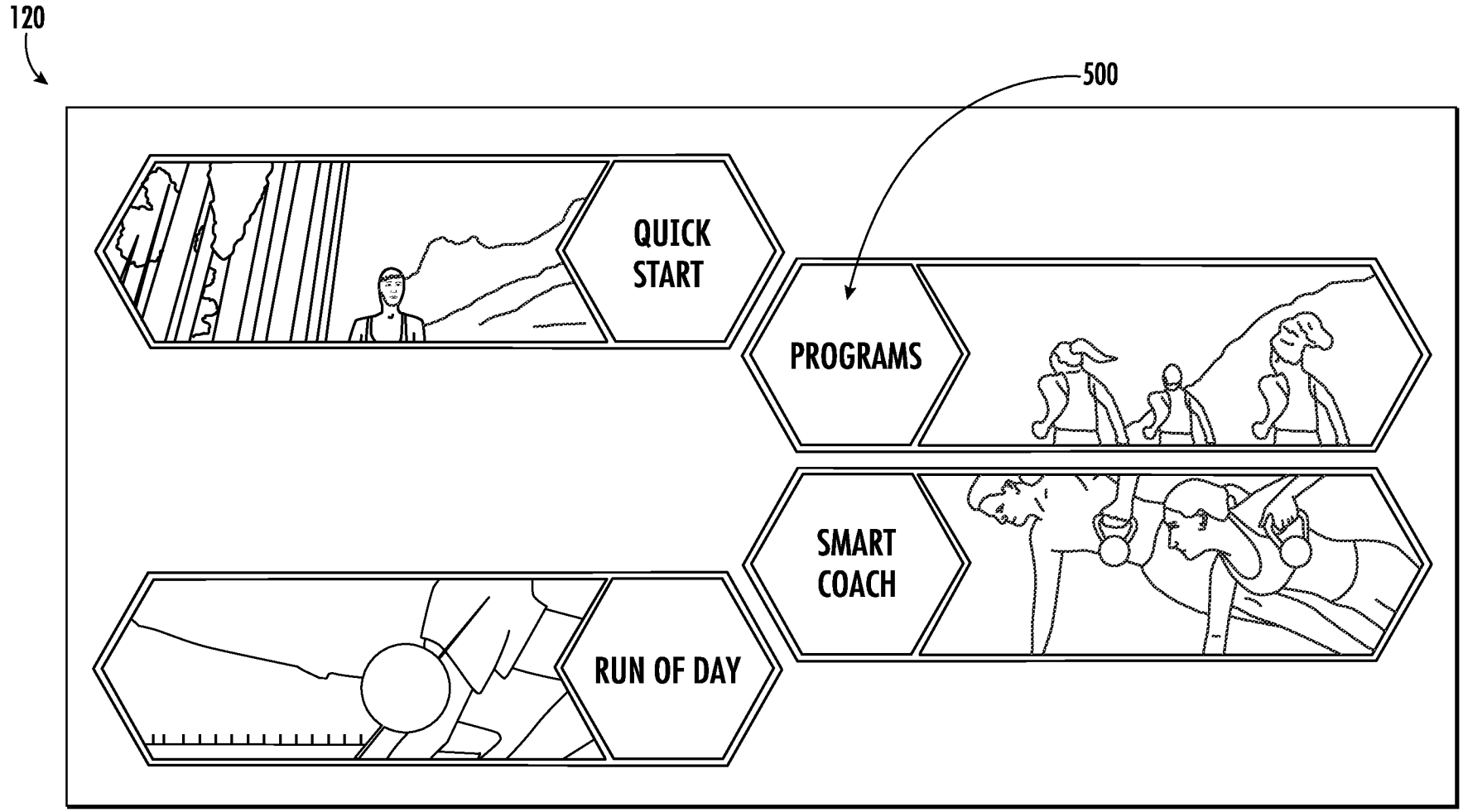
FIG. 5 is a user interface display, which may also be referred to as a graphical user interface, for selecting a program, workout, routine, etc. on the treadmill of FIG. 2 to initiate a group workout mode of operation, according to an exemplary embodiment.

FIG. 5 shows a graphical user interface 500 display, which presents multiple mode options to a user of the motorized treadmill 200. The display 500 may include and configured to register user inputs through a pressure-sensitive, resistive touch screen, and/or a capacitive touch screen. To initiate a group workout program, a user may select (e.g., by hovering, pressing, touching, etc.) a control input region ("Programs") to navigate to a group workout program.

Figure 6:
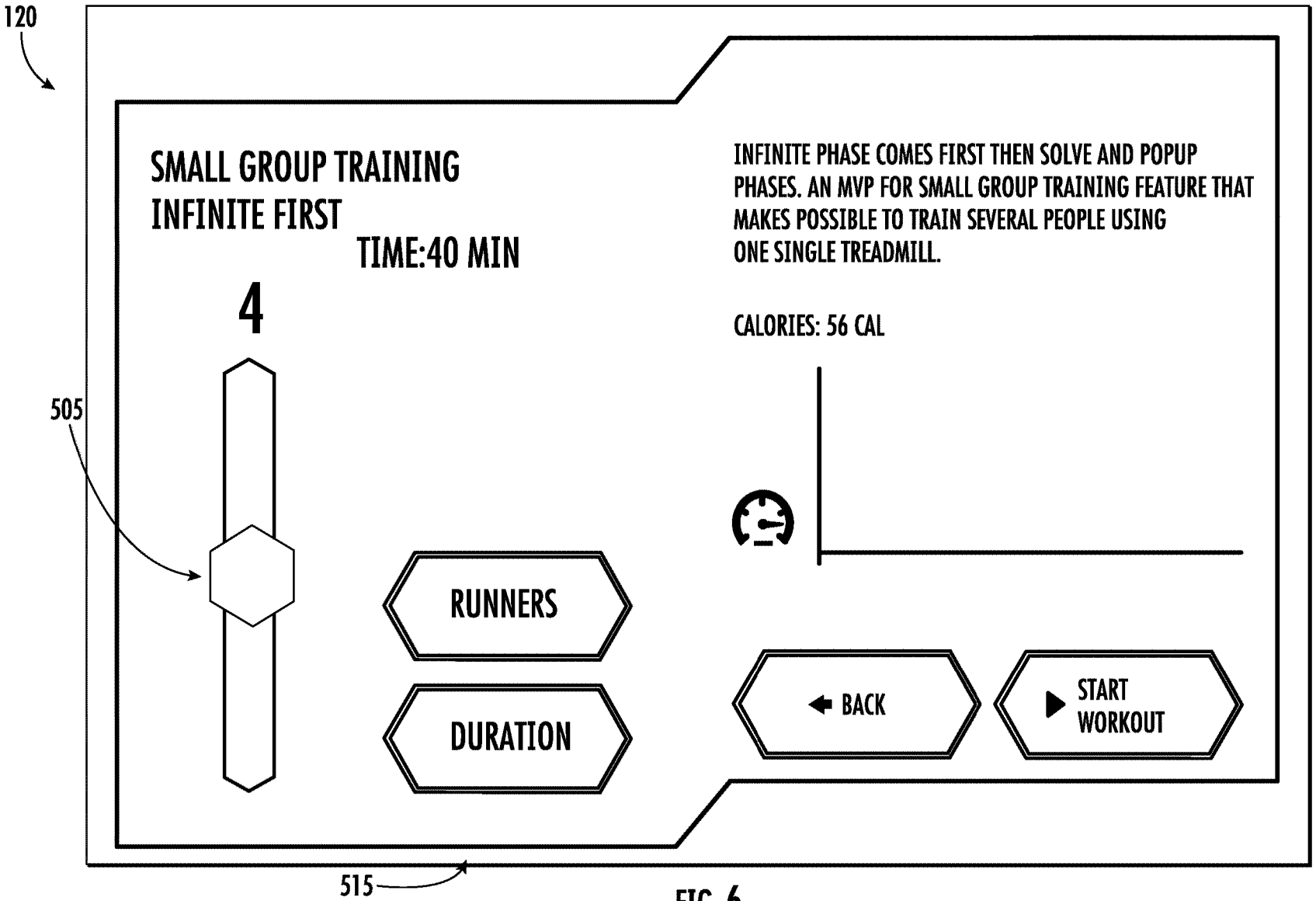
FIG. 6 is a user interface display for initiating a multi-user workout, which may also be referred to as a group workout mode of operation herein, on the treadmill of FIG. 2, according to an exemplary embodiment.

Referring to FIG. 6 and based on receiving a user input of the "Program" icon, the controller 205 may generate and provide a graphical user interface 600 via the input/output device 120 or 400. The graphical user interface 600 may include an input menu for setting group workout parameters for a group workout program ("Small Group Training"). As shown in FIG. 6, the display 600 includes a control input 505, shown as a slide bar, which may be adjusted by the user to set various group workout parameters. The display 600 is also shown to include a group workout input menu 515, which may include control inputs for setting a number of users (i.e., runners) within the group of users of the treadmill 200 and interval times ("Duration"), along with an instructional prompt 520 to provide guidance to the user. In various embodiments, the workout input menu 515 may include additional control inputs to facilitate entry of workout parameters.

Figure 7:
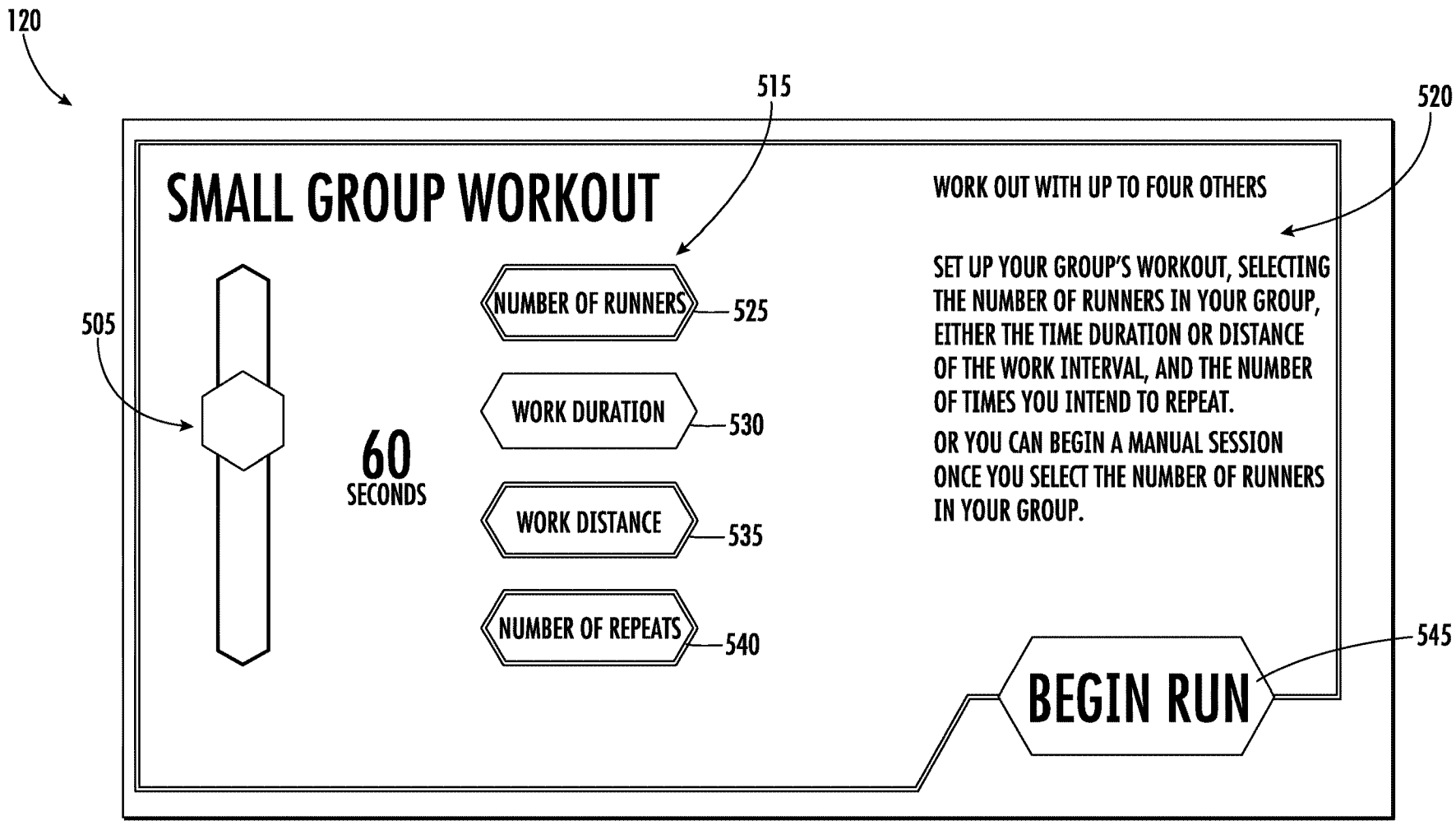
FIG. 7 is a user interface display for starting or initiating a multi-user workout on the treadmill of FIG. 2, according to another exemplary embodiment.

Based on the user selecting the workout duration icon 530, the controller 205 may generate and provide a graphical user interface 700 via the input/output device 120 or 400. To input workout parameters, a user within the group of users may select (e.g., by touching, pressing, clicking, or otherwise engaging with) a region of the graphical display 700 generated by the controller 205 an input control from the workout input menu 515 and adjust the sliding control input 505 to set the parameter corresponding to the selected input control. As shown in FIG. 7, the group workout input menu 515 may include a user count input 525 ("Number of Runners"), an interval time input 530 ("Work Duration"), an interval distance input 535 ("Work Distance") or other interval completion designation (e.g., time threshold, energy expenditure, heart rate, etc.), and a cycle count input 540 ("Number of Repeats"). Once certain parameters for the group workout are set using the group workout input menu 515, the user may select a control input 545 ("Begin Run") on the graphical user interface 700 to start the group mode of operation.

Figure 8:
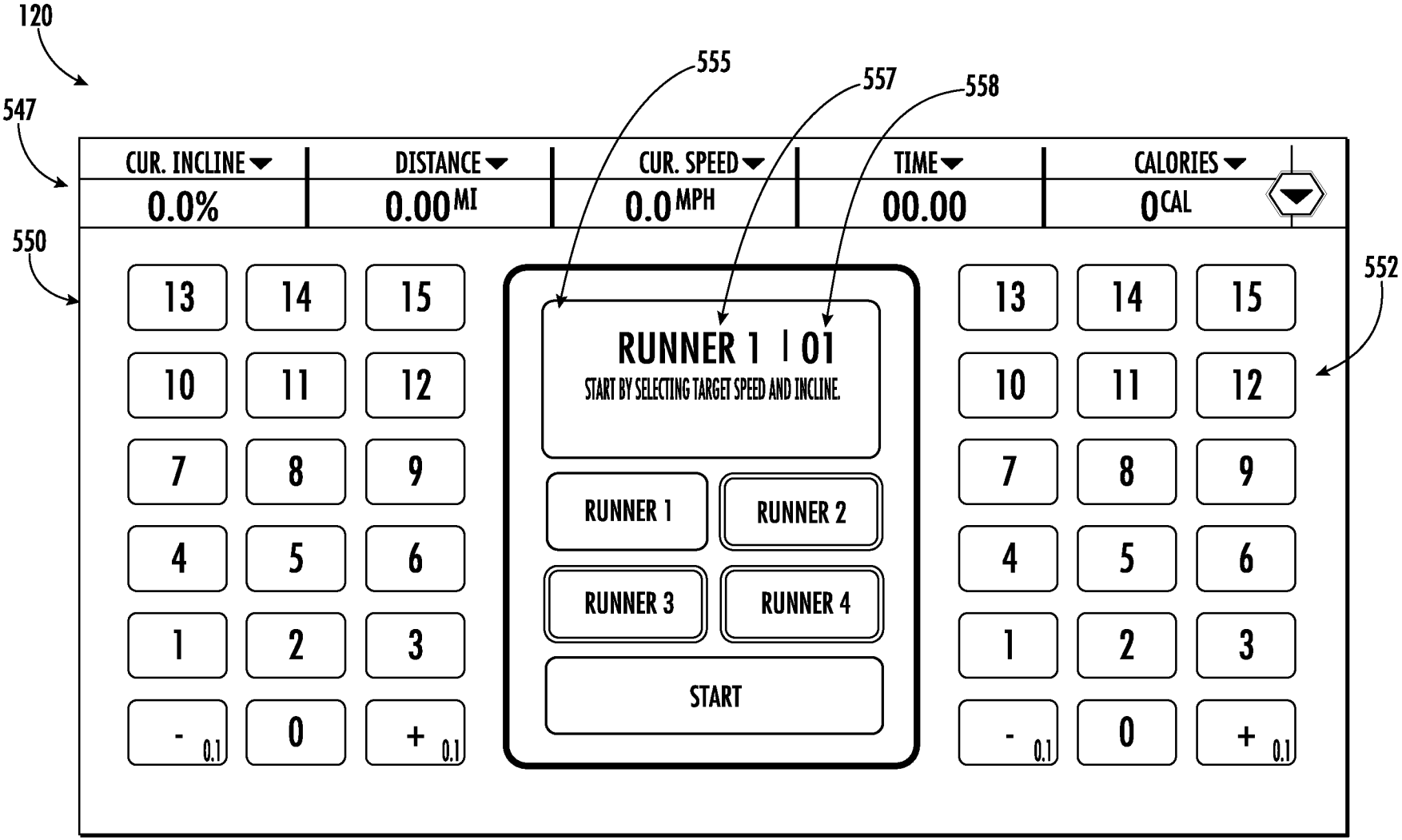
FIG. 8 is a user interface display for receiving workout parameters for a first user of the treadmill of FIG. 2, according to an exemplary embodiment.
Figure 9:
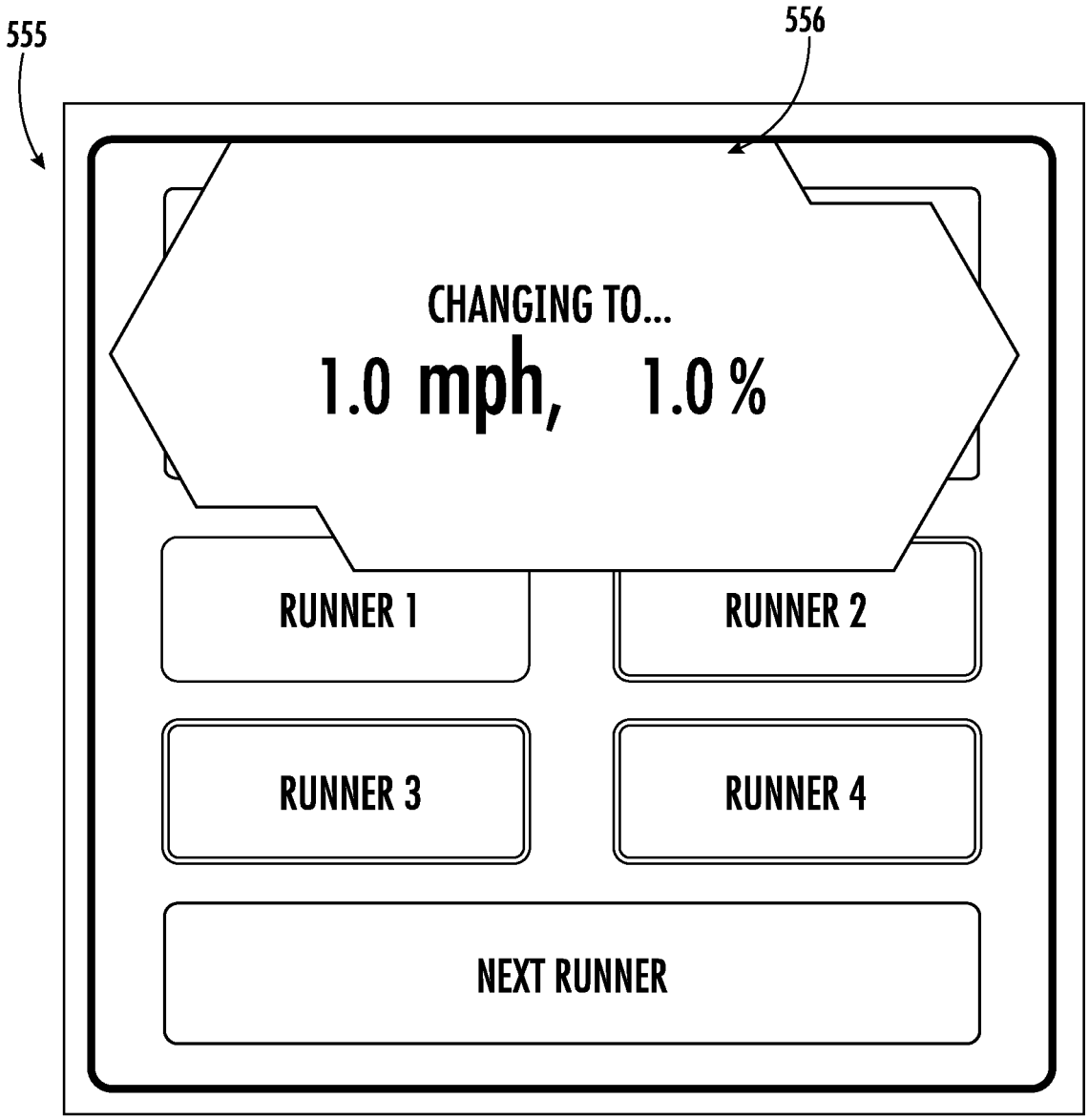
FIG. 9 is a user interface display for receiving workout parameters for a first user of the treadmill of FIG. 2, according to another exemplary embodiment.

Once the group workout is initiated, the controller 205 may generate and provide a graphical user 800 via the input/output device 120 or 400, which includes a runner-specific control input display. As shown in FIG. 8, the graphical user interface 800 includes a runner control menu 555, which includes a first indication 557 of the specific user and/or group workout interval ("Runner 1") and a second indication 558 of the group workout segment ("01"). The display 800 shows a first interval of a group workout corresponding to a first user (i.e., first runner) of the treadmill 200. The display 800 includes a first metric control input 550 configured to receive a target speed input and a second metric control input 552 configured to receive a target incline input. The target speed may either cause the controller 205 to operate the treadmill 200 at the target speed during the specific interval corresponding to a first user, or the target speed may provide a target speed for the first user to achieve measured by the one or more sensors 212) during the first interval. Once user-specific metrics are received via the first and second metric control inputs 550 and 552, the control menu 555 may depict a transition indication 556, which indicates to the first user (i.e., first runner) that at least one of a speed or incline of the treadmill 200 is being adjusted in preparation for the first interval, as shown in FIG. 9. During the first interval, a metric display panel 547 may be included within a graphical display 900 generated by the controller and provided to the input/output device 120 or 400 to show a current incline, distance, speed, time, and/or energy expenditure associated with the first interval.

Figure 10:
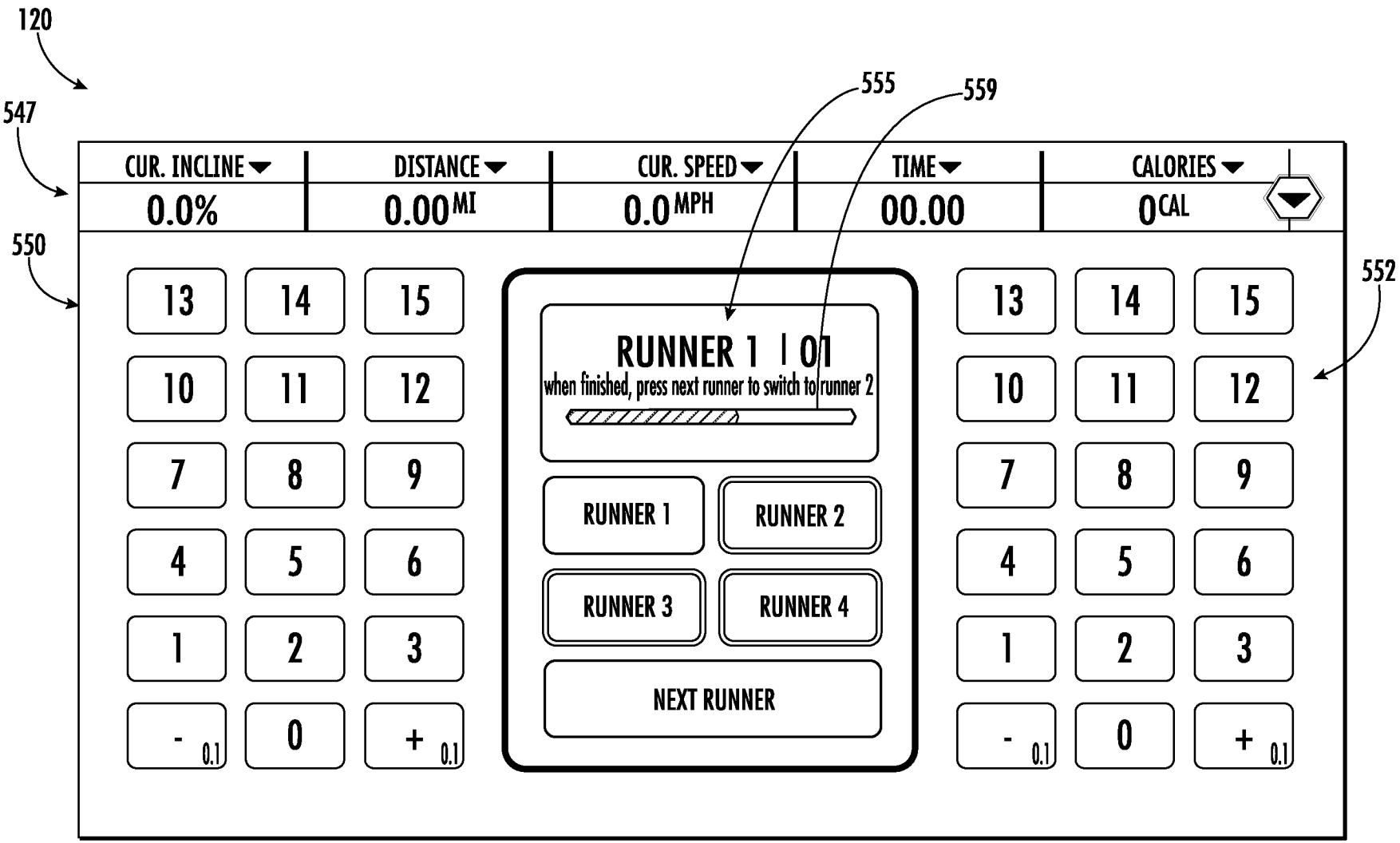
FIG. 10 is a user interface display during a transition between a first user and a second user during the multi-user workout mode of operation for the treadmill of FIG. 2, according to an exemplary embodiment.

After initiation of the multi-user workout via FIG. 9 and as shown in FIG. 10, the controller 205 may generate and provide a graphical user interface 1000 via the input/output device 120 or 400. Once the first interval is completed, the runner control menu depicted on the graphical display 1000 may include one or more indicators of information of a user during their usage of the treadmill ("Runner 1" in this instance) and a progress bar 559 to indicate a transition from the first user to a second user (and thus advance from the first interval to the second interval), wherein the transition may be initiated by selecting the next subsequent user from the control menu 555, as shown in FIG. 10. As shown and in this exemplary embodiment, various information regarding usage of the treadmill is shown, such as a tracked calories amount, time amount, speed, distance, and incline.

Figure 11:
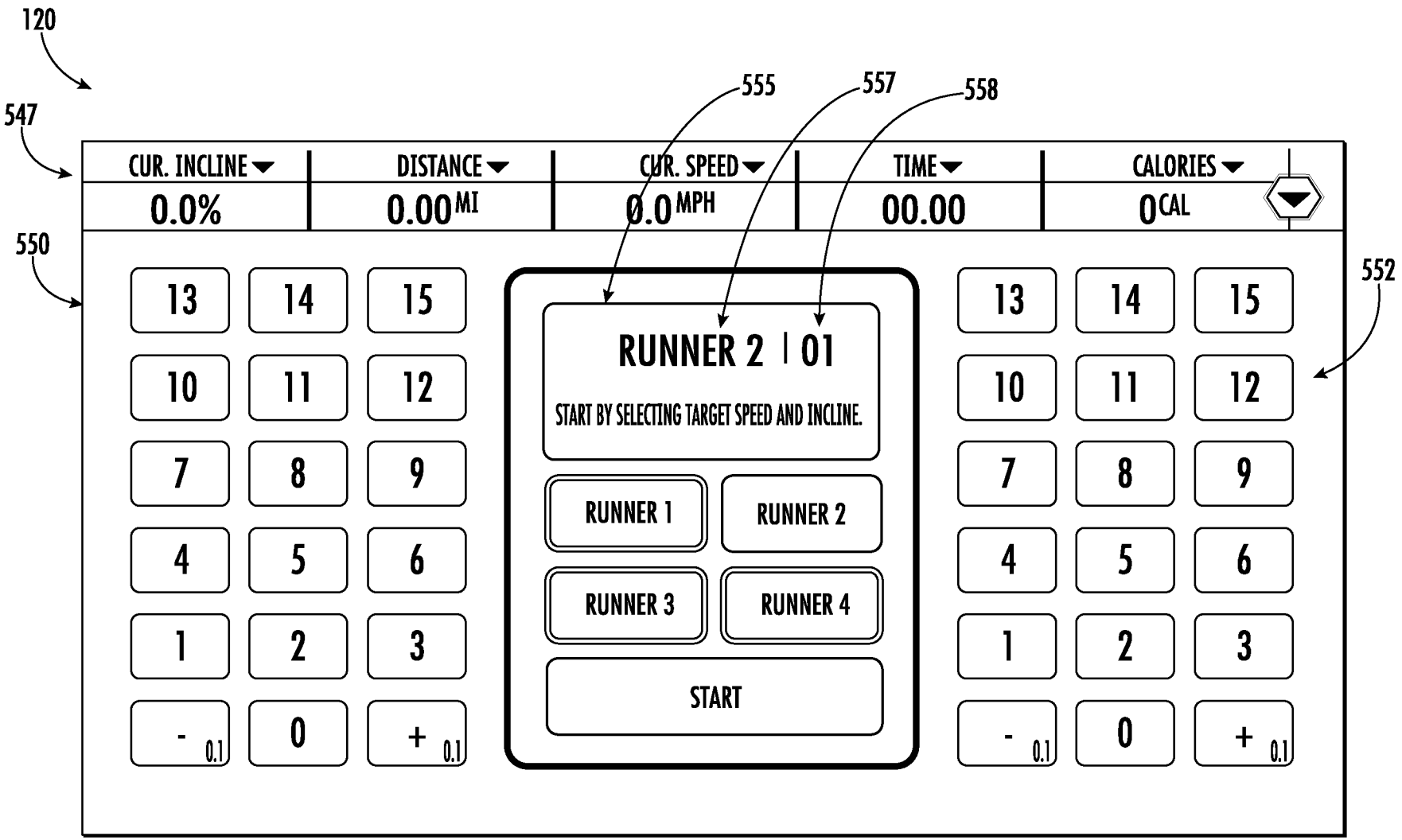
FIG. 11 is a user interface display for inputting and receiving workout parameters for a second user of the treadmill of FIG. 2, according to an exemplary embodiment.

When the runner control menu of the display 1000 is used to advance to the next interval (and thus the next user) and with reference to FIG. 11, the controller 205 may generate a graphical display 1100 that is provided via the input/output device 120 or 400, which includes the control menu 555, wherein the control menu 555 provides the first and second indications 557 and 558 that the second interval is about to begin for the second user ("Runner 2") during the first segment ("01"). Accordingly, the target speed and/or target incline may be input via the control inputs 550, 552 (shown on the graphical display generated by the controller 205) and current interval metrics may then be shown in the display panel 547 (on the graphical display generated by the controller 205) while the second user uses the treadmill 100 during the second interval, as illustrated in FIG. 11.

Figure 12:
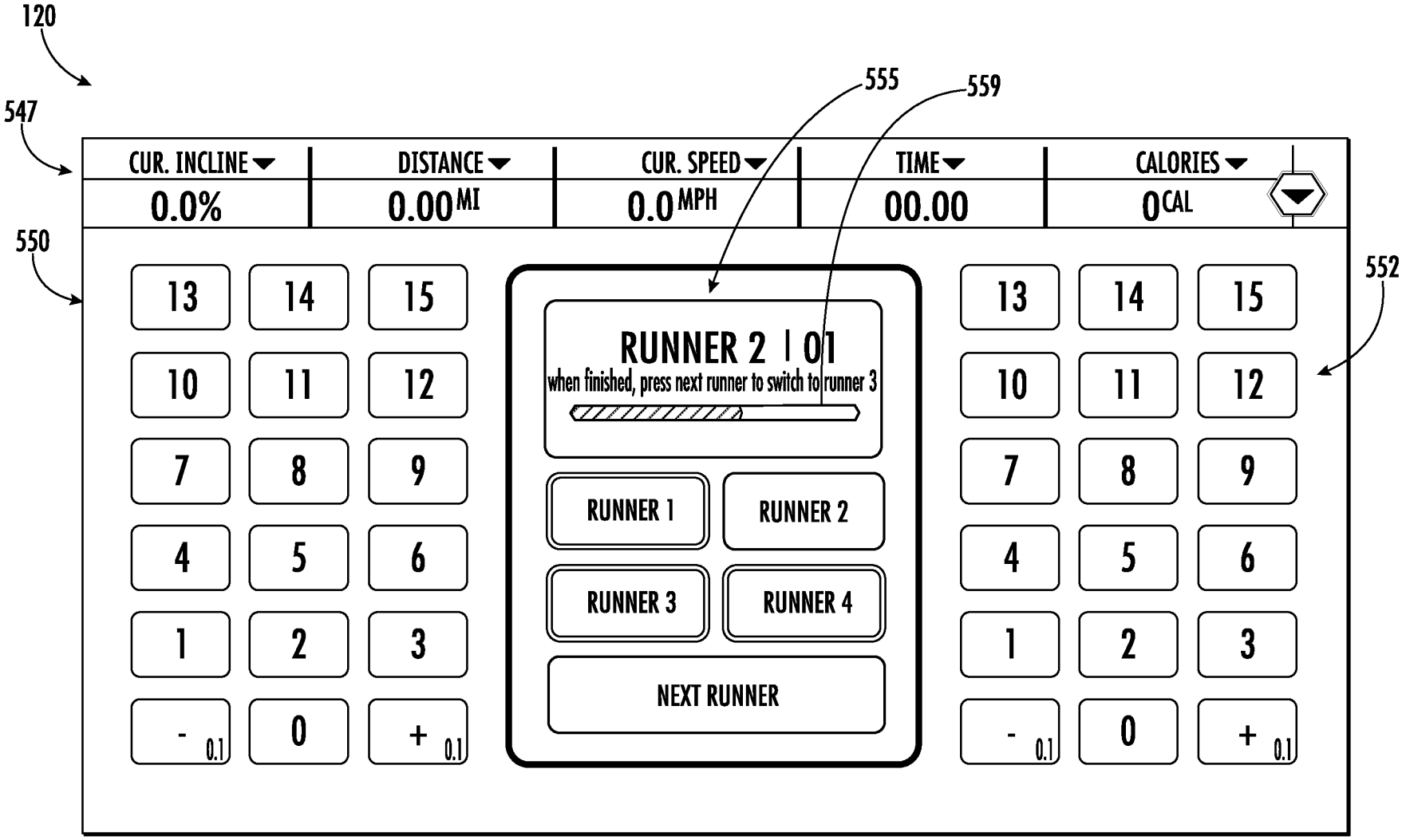
FIG. 12 is a user interface display for inputting and receiving workout parameters for a second user of the treadmill of FIG. 2, according to another exemplary embodiment.

Upon completion of the second interval, the controller 205 may again generate a graphical display, which includes information (e.g., instructions, tracked metrics, etc.) and/or a progress bar 559 provided to the user to prompt a transition from the second user to a subsequent user (and thus advance from the second interval to a subsequent interval). The transition may be initiated by selecting (e.g., by touching, pressing, clicking, or otherwise engaging with) a region of the graphical display 1100 generated by the controller 205 to the next subsequent user from the control menu 555, as shown in FIG. 12. The controller 205 may then cause the input/output device 120 to provide a graphical display, which cycles through depicting prompts to the group mode users of the treadmill 200 to advance through each interval (and thus each user within the group of users) until a segment is completed. Once the segment is complete, the operation will repeat until the preset number of segment cycles or repeats is reached.

Figure 13:
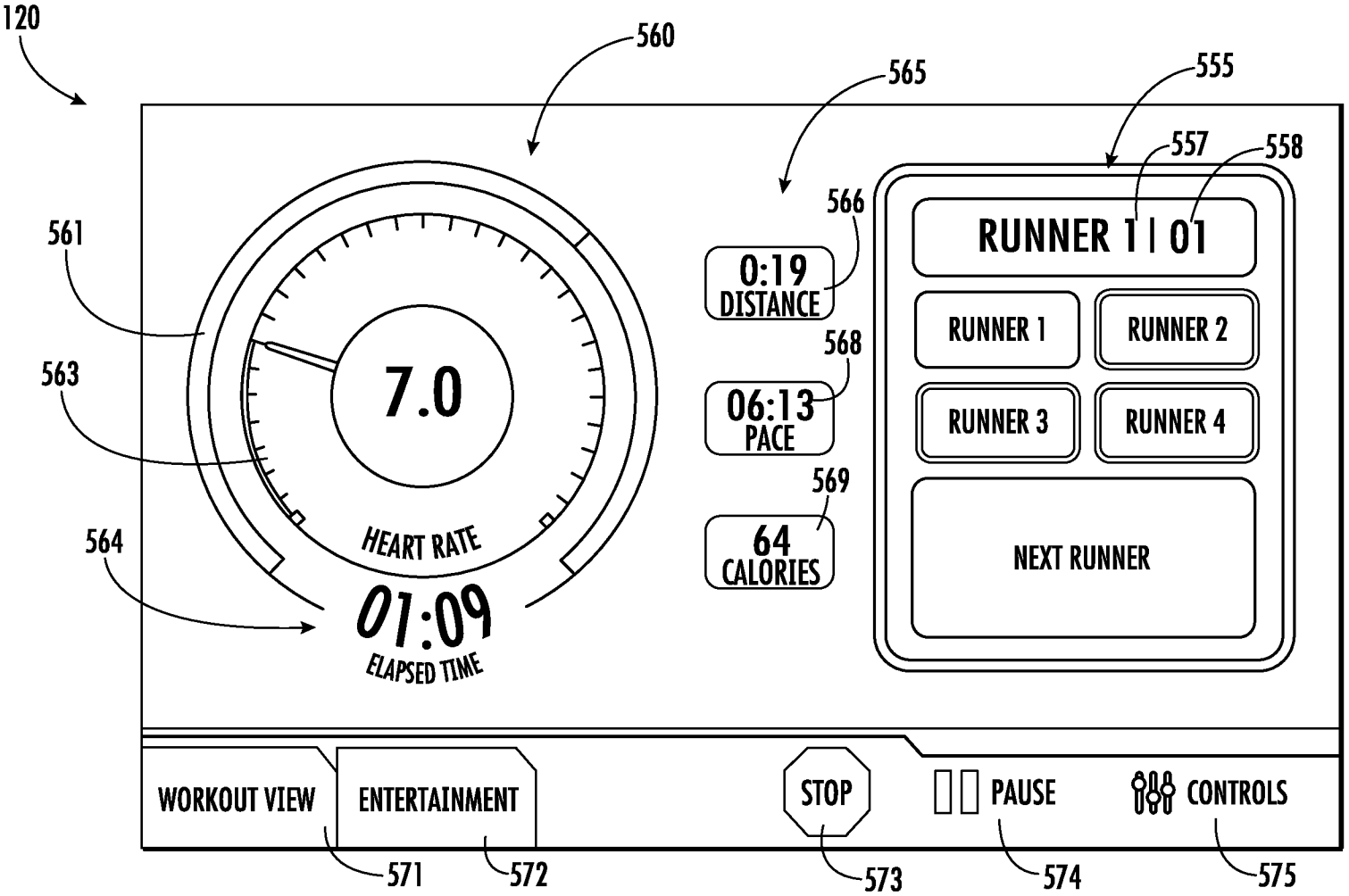
FIG. 13 is a user interface display during a multi-user workout on the treadmill of FIG. 2, according to an exemplary embodiment.

While each user is using (e.g., running, jogging, etc.) on the treadmill 200, the controller 205 may generate a graphical display, which may depict various group workout metrics that may be specific to the group and/or the individual, as shown in FIG. 13 in display 1300. In various embodiments, the graphical display generated by the controller 205 may depict varying positions of the control menu 555 and provide a dynamic display 560 of current workout metrics specific to the current group workout interval. As shown in FIG. 13, the display 1300 may include a progress bar 561 (e.g., progress tracker) that indicates to a user a progress status within the interval, within the segment, and/or within the overall group workout. The display 1300 may also include a speedometer 563, which may indicate a current speed and/or heart rate. The display 1300 may also include a time indication 564, which indicates an elapsed time of the interval, the segment, and/or the group workout as a whole. A window 565 may include additional group workout metrics such as a distance 566 (e.g., distance covered during the interval, during the segment, or during the group workout as a whole), a user pace 568, and/or an amount of energy expended by the user 569 (e.g., in calories). The controller 205 may generate a graphical display, which includes a control menu 570. The control menu 570 may thus enable the user to switch views using a control input 571 ("Workout View"), switch to an alternate function or display using a control input 572 ("Entertainment"), stop the group workout using a control input 573 ("STOP"), pause the group workout or the current interval using a control input 574 ("PAUSE"), and access treadmill 100 and/or control system 200 controls using a control input 575 ("Controls").

Figure 14:
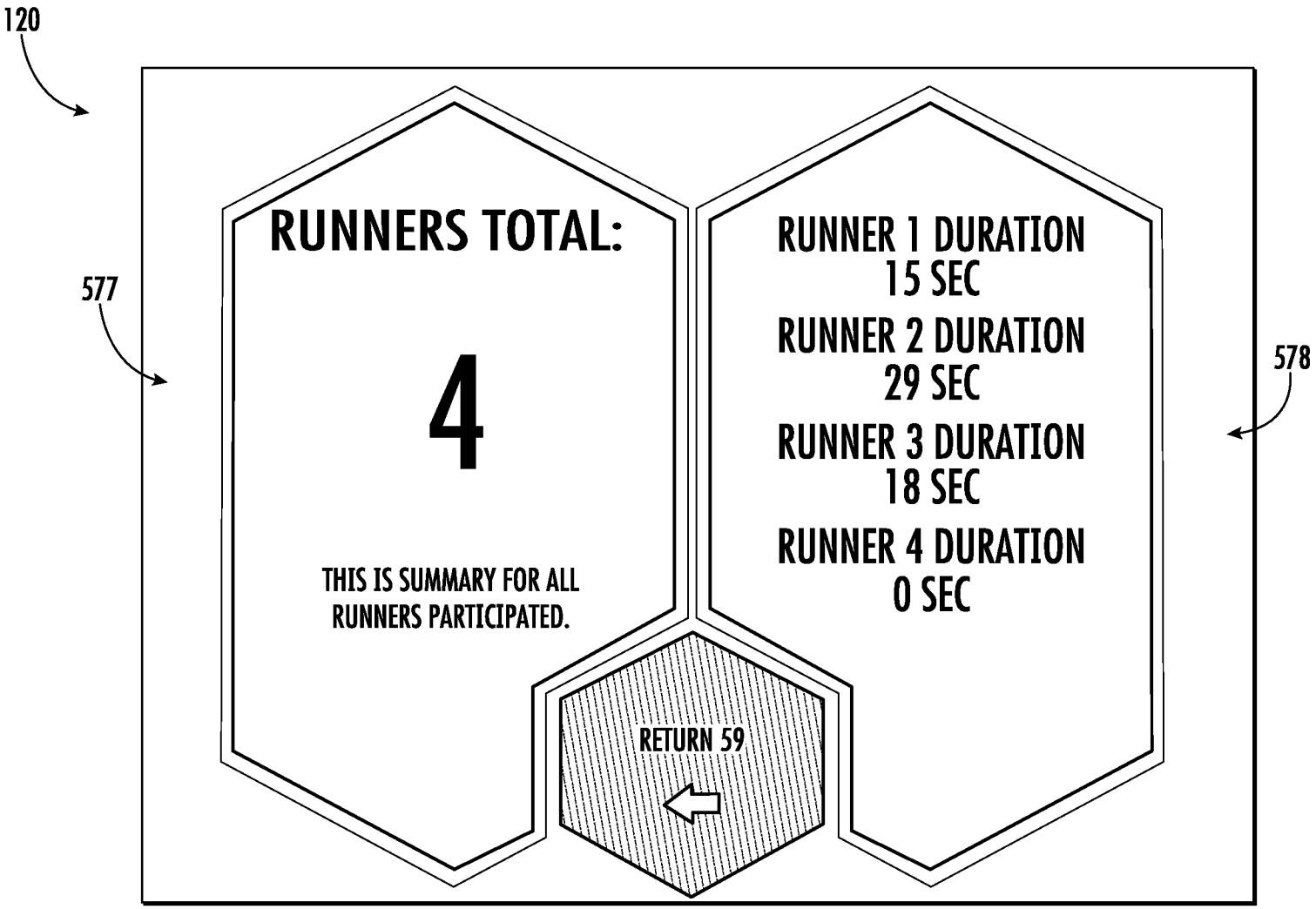
FIG. 14 is a user interface display depicting workout summary information for multiple users of the treadmill of FIG. 2, according to an exemplary embodiment.

Once each interval of each segment of the group workout is completed (i.e., the group workout is complete) and as shown in FIG. 14, the controller 205 may generate a graphical display 1400 (i.e., a summary screen) that is provided via the input/output device 120 or 400. The summary screen may include a depiction 577 of how many users (i.e., runners) participated in the group workout and a second depiction 578 to show one or more summary metrics for each user within the group of users. Although FIG. 14 shows a time (e.g., total time, average time) per interval for each user, the controller 205 may be configured to generate a graphical display depicting any relevant summary metric (e.g., average or peak speed, average or peak pace, distance or average distance, etc.). As shown in FIGS. 8-13, the controller 205 may also be configured to generate graphical displays having adjusted color, tone, font, or other display styles based on which user is currently using the treadmill 100. For example, as shown in FIGS. 8-10, a first user may be indicated by a green theme and, as shown in FIGS. 11-12, a second user may be indicated by a purple theme. Thus, visual cues may be used to signify which user should be on the treadmill and/or when transitions should occur to make the experience pleasing.

As described above, the controller 205 and/or the input/output device 120 may be configured to receive one or more inputs from a user device (e.g., fitness bracelet, smart watch, heart monitor, pacemaker, etc.). In some embodiments, the controller 205 may be configured to record and store (e.g., within the memory 220) group workout summary statistics after each group workout ends. In this way and based on the pairing or syncing described above, the tracked statistics for each user during each interval may be tied to the paired user device. For example, "Runner 1" may have a user device with a device identifier that is tied to "Runner 1" in the controller 205 after pairing. The controller 205 may communicate with the remote computing system 130 to identify the "Runner 1" based on the device identifier. Subsequently, the tracked metrics of Runner 1 may be transmitted to the remote computing system 130 to be associated with the device identifier (or another identifier), which is tied to a particular account associated with the device identifier. Accordingly, the user may retrieve their workout information by logging onto their account (e.g., online). In another embodiment, the user may provide account information directly into the input/output device 120 or 400 via the controller 205 (e.g., account name, email address, or another account identifier) such that the controller 205 may associate the specific user of the group of users to this account information for future storage and retrieval by the user (and, in some embodiments, transmission to the remote computing system 130). Thus and in sum, the controller 205 may tie or otherwise sync each user of the group workout mode to account information (if the account exists) such that the user can retrieve their workout information in the future.

Figure 15:
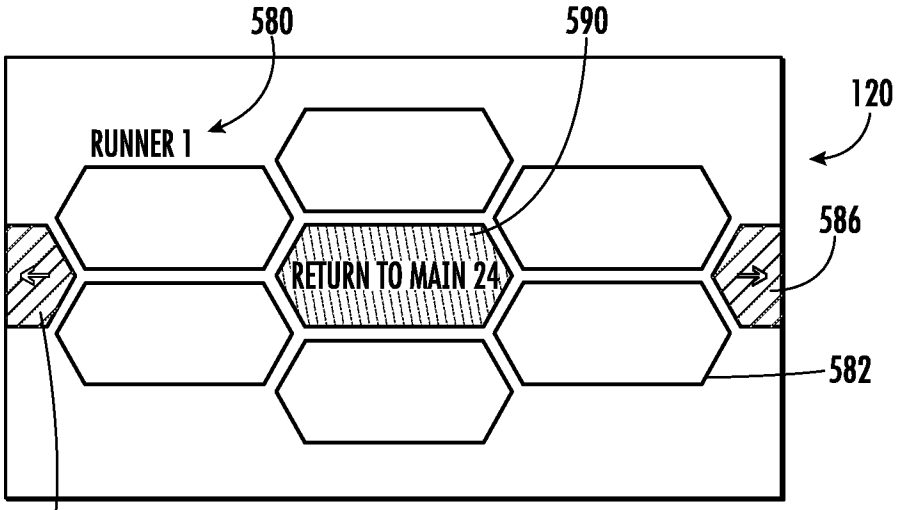
FIG. 15 is a user interface display depicting statistics for a first user of the multi-user workout mode of operation of the treadmill of FIG. 2, according to an exemplary embodiment.
Figure 16:
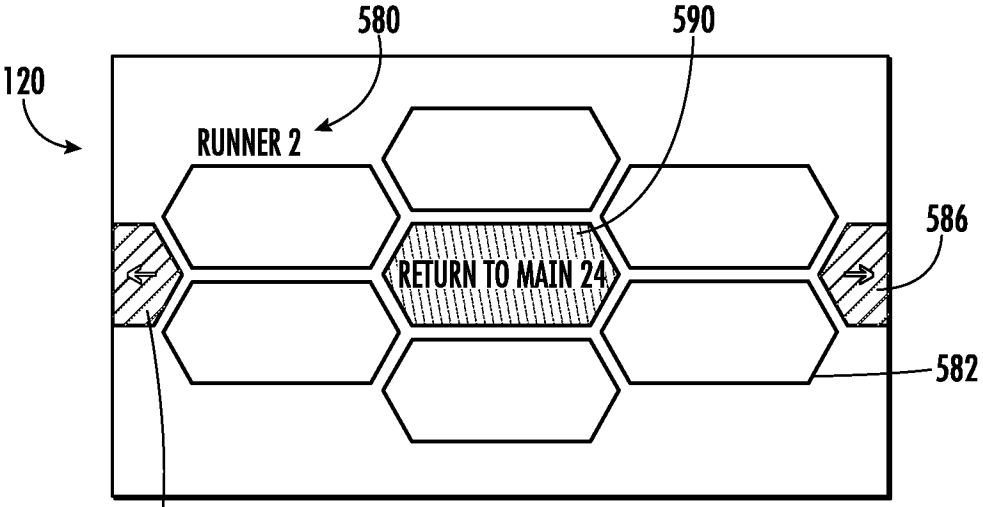
FIG. 16 is a user interface display depicting statistics for a second user of the multi-user workout mode of operation of the treadmill of FIG. 2, according to an exemplary embodiment.

The group workout summary statistics that may be stored by the controller 205 and/or sent to the remote computing system 130 for future retrieval and access may include user-specific group workout metrics from each interval of the group workout. Accordingly, the controller 205 may be configured to store the user-specific group workout metrics and/or the inputs from the user device. The controller 205 may create profiles corresponding to each user within the group workout, wherein the profiles include the stored group workout metrics and/or the user device inputs. Each user profile may be displayed on a graphical display generated by the controller 205 as shown in FIGS. 15 and 16 (displays 1500 and 1600). As illustrated, the controller 205 may generate a graphical display including a profile indicator 580 to indicate which profile is being viewed (e.g., "Runner 1" or "Runner 2"). The controller 205 may also generate a display including a variety of display units 582, which may depict one or more summary statistics or data categories for each user. For example, the display units 582 may show a peak speed, a peak distance, and/or a peak heart rate for the user shown by the profile indicator 580. The controller 205 may also generate a graphical display including navigation controls 585 and 586, which enable switching among user profiles stored by the control system 200, along with a menu control 590, which enables return to a main display (e.g., such as the displays shown in FIGS. 5-7).

Figure 17:
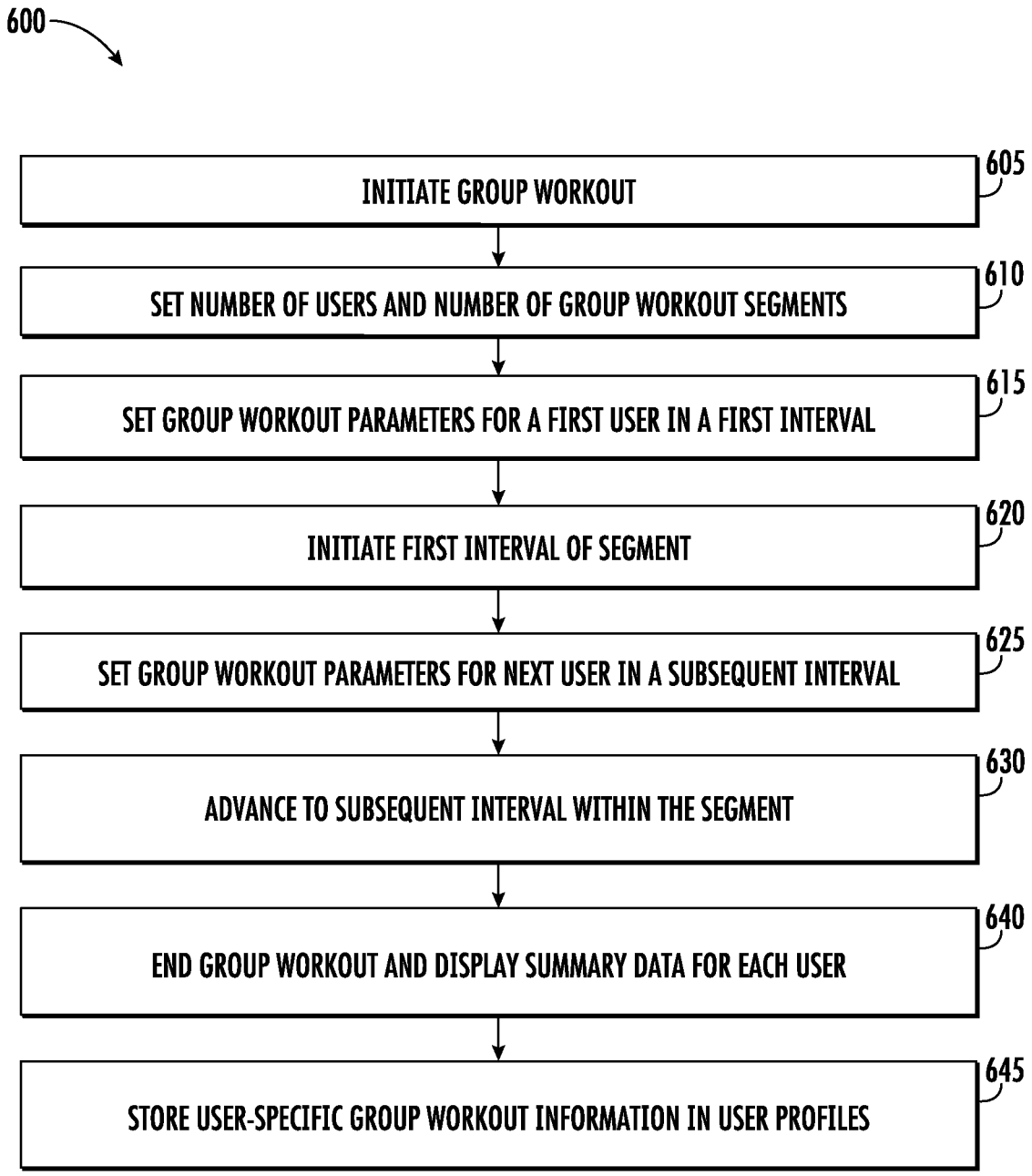
FIG. 17 is a flow diagram of a method of operation of the treadmill of FIG. 2, according to an exemplary embodiment.

Referring now to FIG. 17, another method of operation of the treadmill 200 is shown, according to an example embodiment. In a first operation 605, the multi-user program or group workout is initiated. The controller 205 may then subsequently generate a graphical display, which includes prompts for a user to input a number of users for the group workout in an operation 610. The controller 205 may then cause the input/output device 120 to provide a graphical display including a prompt to a first user to input group workout parameters specific to a first group workout interval of a first group workout segment in an operation 615. The controller 205 may then cause the input/output device 120 to provide a graphical display including a prompt to initiate the first interval in an operation 620. Once the first interval is completed, the controller 205, via the input/output device 120, may prompt a subsequent user to input group workout parameters specific to a subsequent group workout interval of the first group workout segment in an operation 625. The controller 205 may then generate a graphical display including a prompt for initiation of the subsequent interval in an operation 630. The controller 205 may iterate between operations 625 and 630 until each user has completed their corresponding interval within the group workout. The controller 205 may then iterate through operations 620 through 630 until a preset number of group workout segments is completed. Once the group workout segments are completed, the controller 205 may then end the group workout in an operation 640 and display group workout summary information. In a subsequent operation 645, the group workout summary information may then be saved to various user profiles and stored (e.g., within the memory 225 and/or within a database contained within the remote computing system 130). Although the method 600 is described herein in relation to operation of the motorized treadmill 200, the method 600 may be adapted for operation of a non-motorized treadmill, such as the non-motorized treadmill 100 via the controller 205, except that the motor control functionality of the controller 205 may be excluded/removed or disabled.

Notwithstanding the embodiments described above in reference to FIGS. 1-17, various modifications and inclusions to those embodiments are contemplated and considered within the scope of the present disclosure.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. An exercise and/or therapeutic machine, comprising:

a controller comprising at least one processing circuit having at least one processor coupled to at least one memory device, the controller configured to:

receive at least one input indicating a number of users of the exercise and/or therapeutic machine for a multi-user routine and a number of segments of the multi-user routine, each segment of the number of segments having an interval specific to each user of the number of users;

receive at least one completion designation associated with at least one interval, wherein the at least one completion designation indicates a completion of the at least one interval;

transition between each interval of each segment based on detecting the at least one completion designation associated with the at least one interval so that each user of the number of users participates in the multi-user routine on the same exercise and/or therapeutic machine; and generate and provide a display regarding a summary of the multi-user routine.

2. The exercise and/or therapeutic machine of claim 1, wherein the at least one completion designation comprises at least one of a predefined time threshold, a predefined distance threshold, a predefined power generation threshold, a predefined calorie threshold, or a predefined physiological marker threshold for the at least one interval.

3. The exercise and/or therapeutic machine of claim 1, wherein the controller is further configured to receive at least one control parameter for the exercise and/or therapeutic machine for the at least one interval.

4. The exercise and/or therapeutic machine of claim 3, wherein the exercise and/or therapeutic machine includes a treadmill, and wherein the at least one control parameter comprises at least one of a running belt speed designation, an incline designation, or a resistance designation.

5. The exercise and/or therapeutic machine of claim 4, wherein at least one control parameter for at least one interval differs from another at least one control parameter for another at least one interval.

6. The exercise and/or therapeutic machine of claim 1, wherein the exercise and/or therapeutic machine includes a treadmill, and wherein the controller is further configured to slow or stop movement of a running belt of the treadmill between each interval.

7. The exercise and/or therapeutic machine of claim 1, wherein the controller is further configured to generate and provide a notification to at least one user of the number of users regarding the transition between each interval, and wherein the notification is provided to at least one of a display device of the exercise and/or therapeutic machine or a user device associated with the at least one user of the number of users.

8. The exercise and/or therapeutic machine of claim 1, wherein the controller is further configured to provide an audio, a visual, or an audio and visual cue to facilitate the transition between each interval.

9. A method of operating an exercise and/or therapeutic machine, the method comprising:

receiving, by at least one controller of the exercise and/or therapeutic machine, at least one input indicating a number of users of the exercise and/or therapeutic machine for a multi-user routine and a number of segments of the multi-user routine, each segment of the number of segments having at least one interval specific to each user of the number of users;

receiving, by the at least one controller, at least one completion designation associated with the least one interval, wherein the at least one completion designation indicates a completion of the at least one interval;

transitioning, by the at least one controller, between each interval of each segment based on detecting the at least one completion designation associated with at least one interval so that each user of the number of users participates in the multi-user routine on the same exercise and/or therapeutic machine; and generating and providing, by the at least one controller, a display regarding the multi-user routine.

10. The method of claim 9, wherein the at least one completion designation comprises at least one of a predefined time threshold, a predefined distance threshold, a predefined power generation threshold, a predefined calorie threshold, or a predefined physiological marker threshold for the at least one interval.

11. The method of claim 9, further comprising receiving at least one control parameter for the exercise and/or therapeutic machine for at least one interval, wherein the exercise and/or therapeutic machine includes a treadmill, and wherein the at least one control parameter comprises at least one of a running belt speed designation, an incline designation, or a resistance designation.

12. The method of claim 11, wherein at least one control parameter for at least one interval differs from another at least one control parameter for another at least one interval.

13. The method of claim 9, wherein transitioning between each interval comprises adjusting at least one operational setting of the exercise and/or therapeutic machine.

14. The method of claim 13, further comprising generating and providing a notification to at least one user device associated with at least one user of the number of users indicating the transition.

15. The method of claim 14, wherein the notification comprises a visual, an audible, and audio and visual, or a haptic notification.

16. A treadmill comprising:

a display device;

a controller coupled to the display device, the controller comprising at least one processing circuit having at least one processor coupled to at least one memory device, the controller configured to:

receive at least one input indicating a number of users of the treadmill for a multi-user routine and a number of segments of the multi-user routine, each segment of the number of segments having an interval specific to each user of the number of users;

receive at least one completion designation associated with at least one interval of at least one segment, wherein the at least one completion designation indicates a completion of the at least one interval of the at least one segment;

transition between adjacent intervals of a segment based on detecting the at least one completion designation associated with the at least one interval so that at least two users of the number of users participate in the multi-user routine on the treadmill; and cause the display device to provide a display regarding a summary of the multi-user routine.

17. The treadmill of claim 16, wherein the controller is further configured to receive at least one control parameter for the treadmill for at least one interval.

18. The treadmill of claim 17, wherein the treadmill is a motorized treadmill, and wherein the at least one control parameter comprises at least one of a running belt speed designation or an incline designation.

19. The treadmill of claim 16, wherein the controller is further configured to adjust at least one control parameter of the treadmill during the transition between each adjacent interval.

20. The treadmill of claim 16, wherein the at least one completion designation is a predefined physiological marker, and wherein the controller is coupled to a user device and configured to wirelessly receive information regarding the physiological marker to determine that the at least one completion designation is met based on the received information.

* * * * *